US011986068B2

(12) United States Patent
Barros

(10) Patent No.: US 11,986,068 B2
(45) Date of Patent: May 21, 2024

(54) WEARABLE DEVICE WITH EXCHANGEABLE PARTS

(71) Applicant: Wilson Eduardo Barros, New York, NY (US)

(72) Inventor: Wilson Eduardo Barros, New York, NY (US)

(73) Assignee: Wilson Eduardo Barros, New York, NY (US)

( * ) Notice: Subject to any disclaimer, the term of this patent is extended or adjusted under 35 U.S.C. 154(b) by 0 days.

(21) Appl. No.: 17/898,120

(22) Filed: Aug. 29, 2022

(65) Prior Publication Data

US 2023/0040526 A1 Feb. 9, 2023

Related U.S. Application Data

(63) Continuation of application No. 16/848,314, filed on Apr. 14, 2020, now Pat. No. 11,439,211.

(60) Provisional application No. 62/837,999, filed on Apr. 24, 2019.

(51) Int. Cl.
*A44C 5/12* (2006.01)

(52) U.S. Cl.
CPC ..... *A44C 5/12* (2013.01)

(58) Field of Classification Search
CPC ..... A44C 15/004; A44C 9/00; A44C 5/12; A44C 5/025; A44C 5/10; A44C 5/00; A44C 5/0007; A44C 5/0015; A44C 5/0023; A44C 17/0208; A44C 17/0216; A44C 17/0241; A44C 17/025; G09F 7/16
See application file for complete search history.

(56) References Cited

U.S. PATENT DOCUMENTS

| | | | | |
|---|---|---|---|---|
| 2,653,402 | A * | 9/1953 | Bonagura | G09F 7/16 63/3 |
| 6,880,364 | B1 | 4/2005 | Vidolin | |
| 8,872,729 | B2 * | 10/2014 | Lyons | G06F 1/163 345/1.1 |
| D866,386 | S | 11/2019 | Saxena | |
| 10,932,534 | B2 * | 3/2021 | Green | A44C 25/001 |
| 2003/0221449 | A1 | 12/2003 | DeShong | |
| 2015/0124567 | A1 | 5/2015 | Liao | |
| 2017/0231338 | A1 | 8/2017 | Thomas | |
| 2017/0303646 | A1 | 10/2017 | Bricken | |

OTHER PUBLICATIONS

DNA Strands Bracelet; Biology jewelry—Science jewelry | IFLScience Store—IFLScience Store USA, ID# 109834108955, Mar. 30, 2019.
The Fashion Law; The Enduring Appeal of the Cartier Love Bracelet & the Legal Protections Behind It; Oct. 11, 2017.

(Continued)

*Primary Examiner* — Jack W Lavinder
(74) *Attorney, Agent, or Firm* — Hogan Lovells US LLP

(57) ABSTRACT

A wearable device is disclosed. The wearable device includes one or more design members; at least one ornamental member having one or more grooves to move the one or more design members into or out of the at least one ornamental member through at least one guide path; and a latch associated with the at least one guide path and having at least one locking member for interlocking, at least partially, with a port of the at least one ornamental member.

20 Claims, 21 Drawing Sheets

(56) References Cited

OTHER PUBLICATIONS

Etsy; Plexus Swag Plexus Bracelet Silver Plexus Jewelry Rhinestone, Mar. 30, 2019.
Otto Frei; Pins, Tubes & Screws for Omega Seamaster & Speedmaster Bracelets, Mar. 30, 2019.
Nordstrom; Miansai 'Reeve' Gold Hinge Bracelet, Mar. 30, 2019.
Restriction Requirement issued in U.S. Appl. No. 16/848,314, dated Jun. 30, 2021.
Non-Final Office Action issued in U.S. Appl. No. 16/848,314, dated Oct. 14, 2021.
Final Office Action issued in U.S. Appl. No. 16/848,314, dated Feb. 3, 2022.
Notice of Allowance issued in U.S. Appl. No. 16/848,314, dated May 23, 2022.
Notice of Allowance issued in U.S. Appl. No. 16/848,314, dated Jun. 15, 2022.

* cited by examiner

WEARABLE DEVICE WITH EXCHANGEABLE PARTS

CROSS-REFERENCE TO RELATED APPLICATIONS

The present disclosure is a continuation of U.S. patent application Ser. No. 16/848,314, filed Apr. 13, 2020 and issued as U.S. Pat. No. 11,439,211, which is related to and claims the benefit of priority from U.S. Provisional Application 62/837,999, filed Apr. 24, 2019, both of which are titled WEARABLE DEVICE WITH EXCHANGEABLE PARTS, and the entire disclosures of both of which are incorporated by reference herein for all intents and purposes.

BACKGROUND

The present disclosure generally relates to wearable devices, and in particular, to wearable jewelry or products that include exchangeable parts that are easily exchanged to customize the wearable jewelry or products by a customer.

Wearable products, including jewelry, are set during manufacture so that components are secure when customers wear the products. However, such jewelry may have limited use depending on occasions associated with the type of jewelry. For example, certain elaborate wearable products may only suit evening and special occasions. Further, wearable products also exist in a belt or bracelet format with charms that may slide over the bracelet or belt. Other wearable products allow charms to be linked together by a base material—such as, threads, springs, and jewelry-adorned structures. These products may be customized by changing the charms. The charms are, however, not fixed, and may move during wear. Additionally, the charms may be dislodged from intended positioning on the base material. Still further, the number of charms is limited by corresponding locations on the bracelet and the wearable products are difficult to replace the charms on the customer side.

SUMMARY

A wearable device is disclosed to address at least the deficiencies noted above. The wearable device includes at least one ornamental member having an opening and a latch there between. One or more grooves are in the at least one ornamental member. At least one guide path to the one or more grooves exist to guide design members into or out of the one or more grooves. At least one locking member of the wearable device locks the design members within the one or more grooves. Further, at least one latching member of the wearable device is provided adjacent to the one or more grooves to receive a latch and to enable releasable locking of the latch.

In another aspect, a method for manufacturing a wearable device is disclosed. The method includes machining at least one ornamental member having an opening and a latch there between. Sub-processes of the method include providing one or more grooves in the at least one ornamental member and providing at least one guide path to the one or more grooves to guide design members into or out of the one or more grooves. The method also includes a sub-process of enabling at least one locking member to lock the design members within the one or more grooves. Further, the method includes locating at least one latching member adjacent to the one or more grooves to receive a latch and to enable releasable locking of the latch.

BRIEF DESCRIPTION OF THE DRAWINGS

Some of the features and benefits of the present invention having been stated, others will become apparent as the description proceeds when taken in conjunction with the accompanying drawings, in which.

Figure 1:
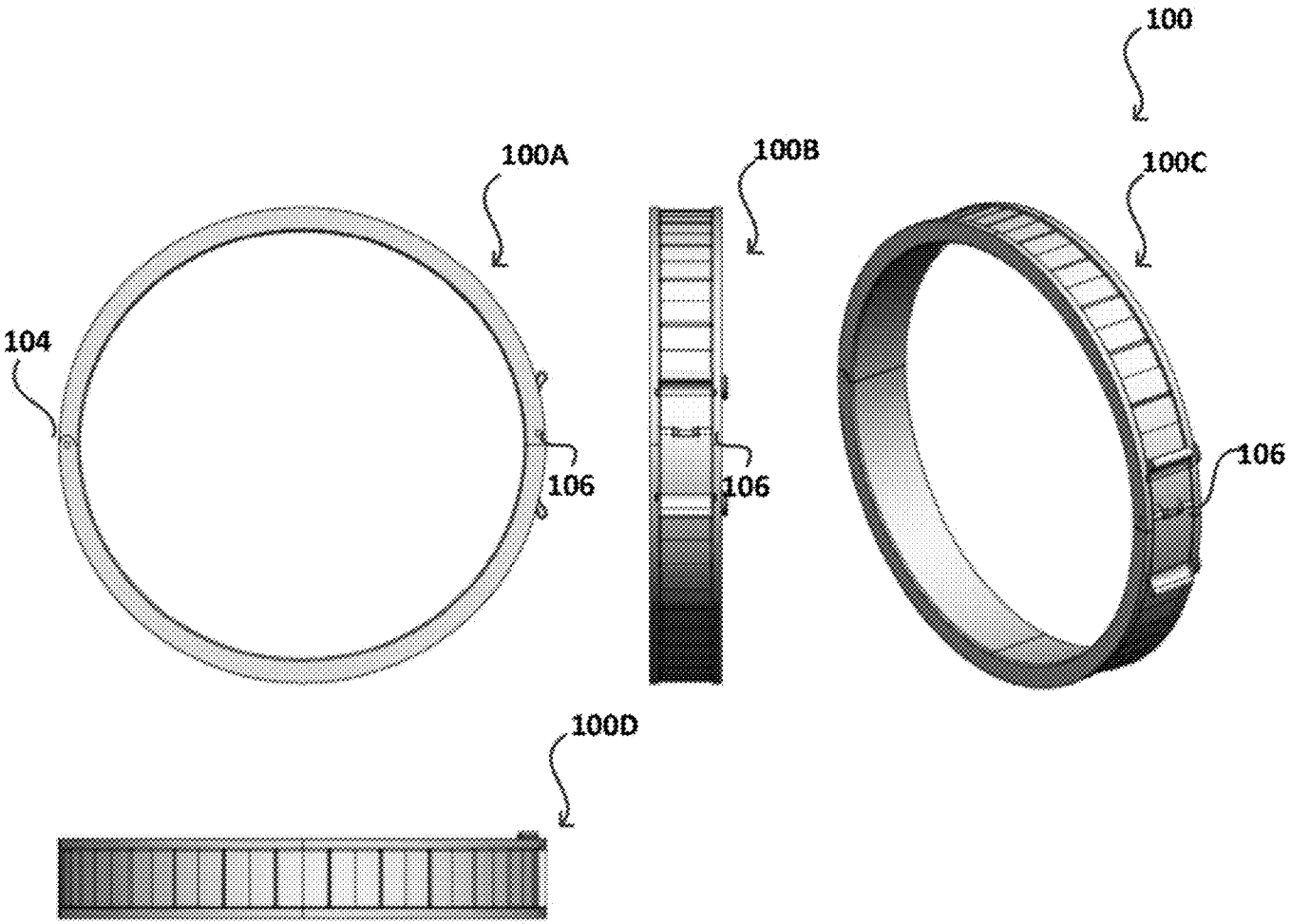
FIG. 1 is a wearable device with exchangeable parts, in different views, in accordance with an aspect of the present disclosure.

While the invention will be described in connection with the preferred embodiments, it will be understood that it is not intended to limit the invention to that embodiment. Instead, the preferred embodiments are intended to cover all alternatives, modifications, and equivalents, as may be included within the spirit and scope of the invention as defined by the appended claims

DETAILED DESCRIPTION OF THE DISCLOSURE

So that the manner in which the features and advantages of the embodiments of wearable jewelry or products that include exchangeable parts, as well as methods to manufacture and others, which will become apparent, may be understood in more detail, a more particular description of the embodiments of the present disclosure briefly summarized previously may be had by reference to the embodiments thereof, which are illustrated in the appended drawings, which form a part of this specification. It is to be noted, however, that the drawings illustrate only various embodiments of the disclosure and are therefore not to be considered limiting of the present disclosure's scope, as it may include other effective embodiments as well.

The wearable jewelry or products and associated methods of manufacture of the present disclosure will now be described more fully hereinafter with reference to the accompanying drawings in which embodiments are shown. The wearable jewelry or products and associated methods of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 is an example schematic 100, as well as detailed designs, in different views of a wearable device with exchangeable parts in accordance with an aspect of the present disclosure. A wearable device 100A, 100B, 100C includes a first section 242A and a second section 242B with a locking mechanism 106 in between the sections. The locking mechanism 106 may be a latch to associate with a traversing pin described elsewhere in this disclosure. While two sections are shown, it may also be the case that the wearable device, in an aspect, is a single section or ornamental member having an opening with the locking mechanism on one side and a traversing pin on the other side to close the opening when the wearable device is worn. One or more hinges, e.g., hinge 104, or other relative movement feature, may be provided if the wearable device has multiple sections that move relative to each other with the goal of creating room for adjusting the wearable device, allowing for exchanging of parts, and for closing the wearable device when it is worn. Locking pins are provided to lock exchangeable parts or design members within the wearable device.

Further, FIG. 1 illustrates a side view as in wearable device 100A, 100D; a front view as in wearable device 100B; and an angled view as in wearable device 100C. A person of ordinary skill would recognize that the wearable device of reference numerals 100A-C represents different views the wearable device.

Figure 2A:
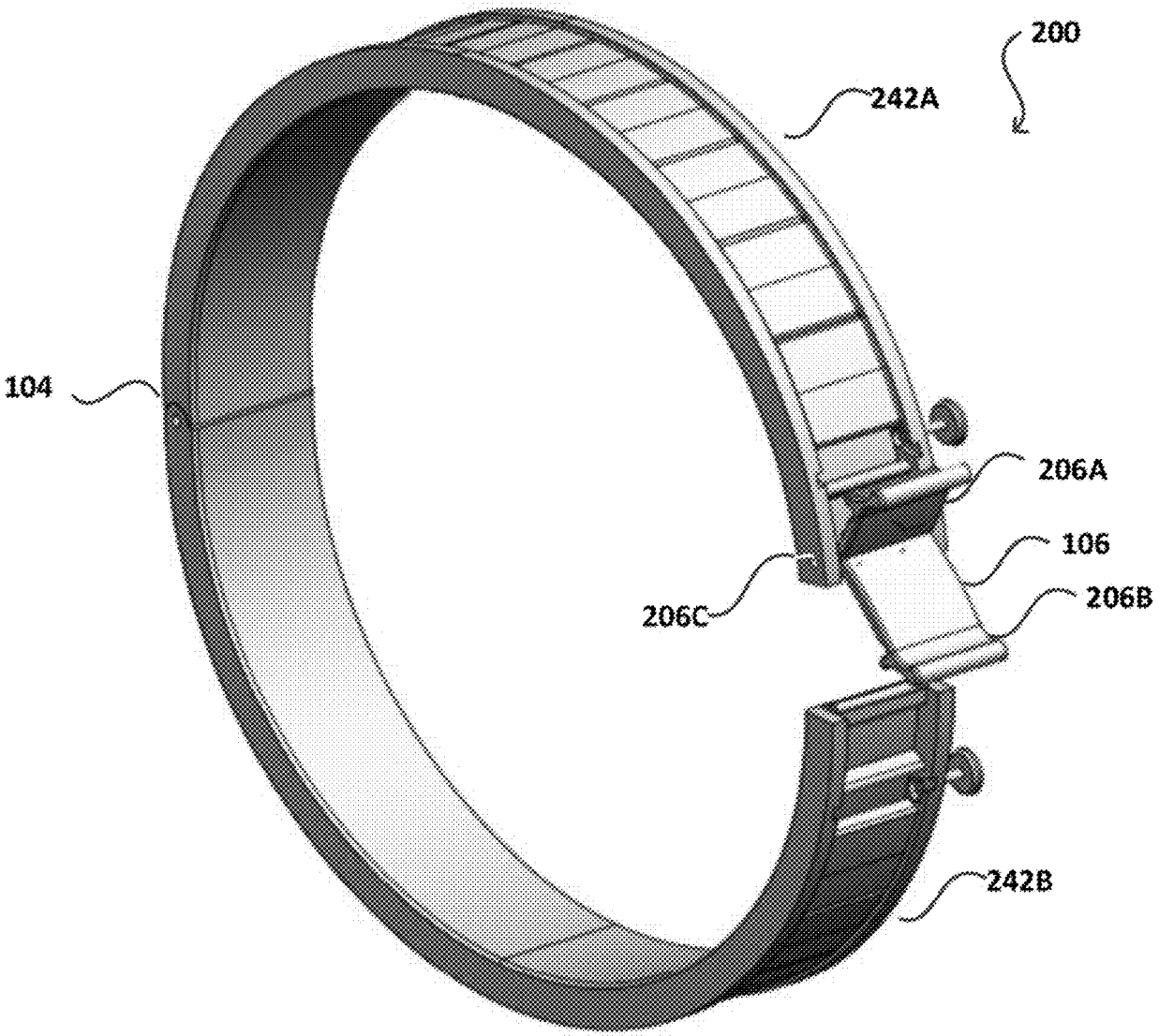
FIGS. 2A, 2B, and 2C are detailed views of the wearable device with exchangeable parts, as in FIG. 1, in accordance with an aspect of the present disclosure.
Figure 2B:
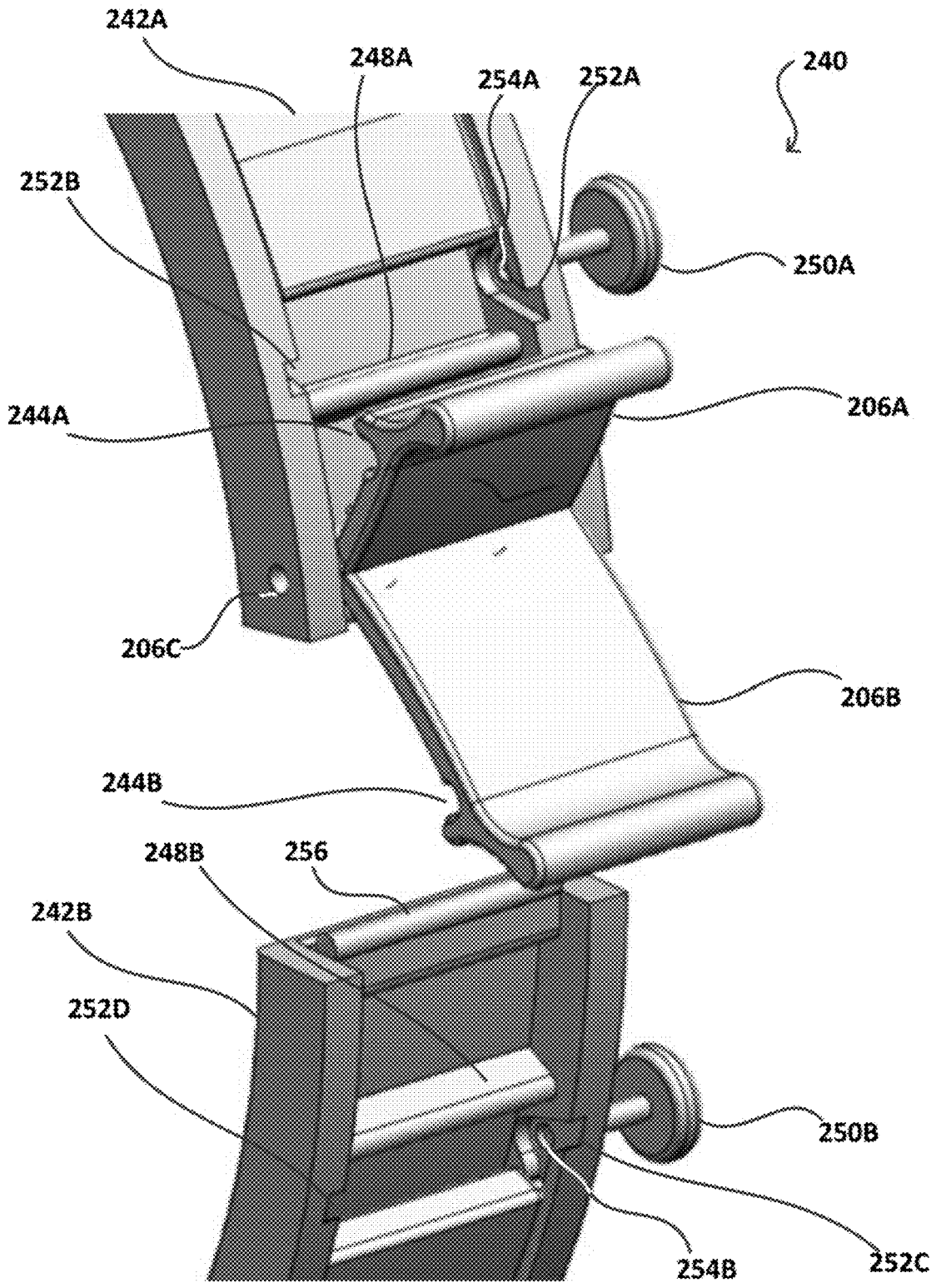
Figure 2C:
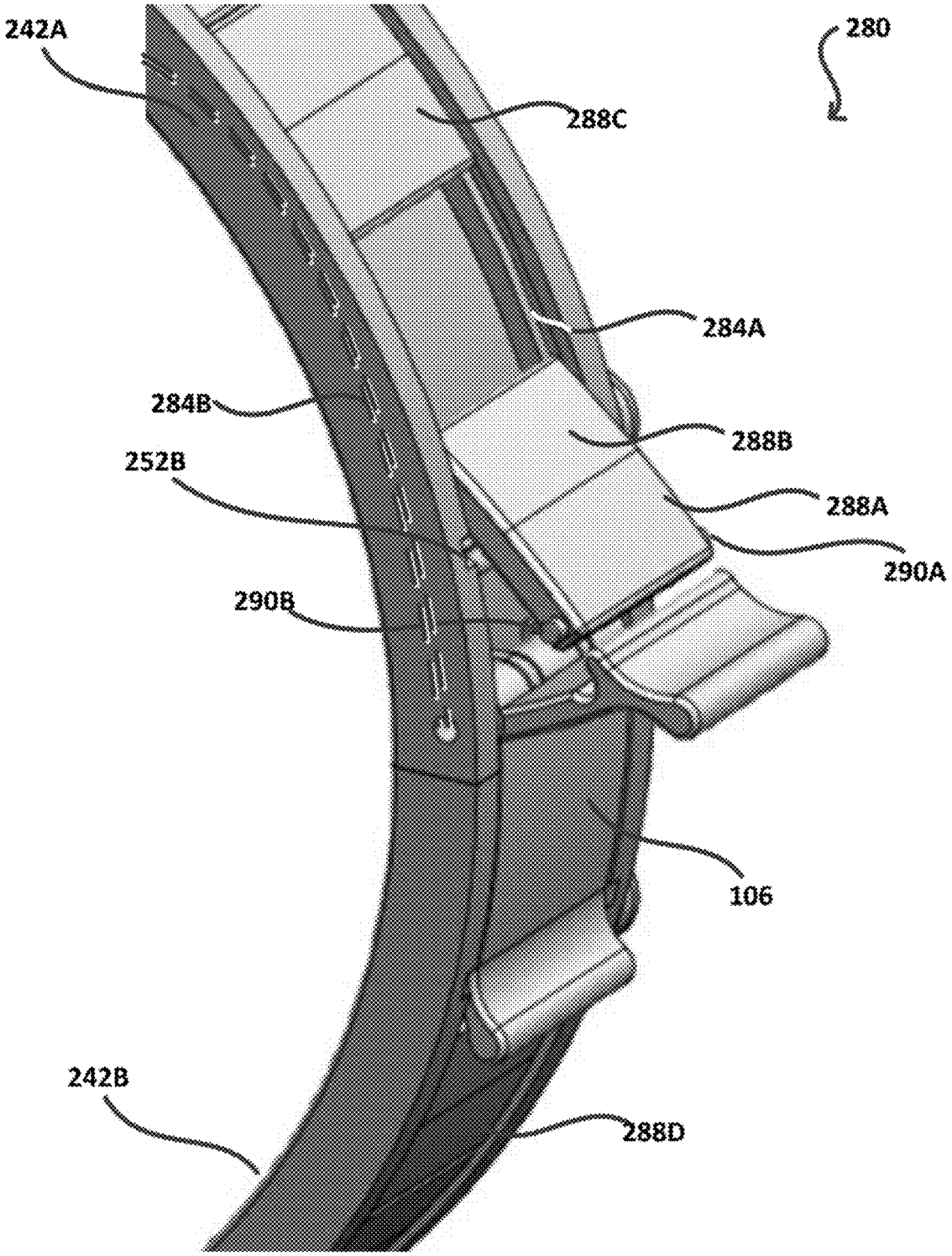

FIGS. 2A, 2B, and 2C are example schematics 200, 240, 280, as well as detailed designs, providing detailed views of aspects of the wearable device with exchangeable parts in accordance with the present disclosure. The wearable device in each of these figures may be the same or similar to wearable device 100A, 100B, 100C in FIG. 1. FIG. 2A illustrates sections 242A, 242B with a hinge 104 that allows relative motion of the sections. A locking mechanism 106 is illustrated in further detail. The locking mechanism 106 may be a latch or multiple latches and may include latching grooves in areas 206A, 206B for engaging corresponding traversing pins (e.g., 248A, 248B) that form latching members. Further details is providing in the illustrations following FIG. 2A. FIG. 2B illustrates at least one guide path 252A (other guide paths include paths marked by reference numerals 252B-D) to first grooves in the first section and to second grooves in the second section. The first and second grooves are illustrated in FIG. 2C. The one or more guide paths 252A-D guide design members into or out of the first grooves and the second grooves. As illustrated, the guide paths are angled relative to the first and the second grooves.

FIG. 2B also illustrates locking pins 250A, 250B, forming locking members, to restrict the design members from moving or coming out of the wearable device, once inserted. A screw in the locking pin 250A, 250B, illustrated as the rod extending from a pin head, is provided for threading the locking pin at least partially into an internal side 254A, 254B of the first section. The screw then abuts the first grooves so that the design members are restricted to within the first grooves by an abutment of the locking pin. Alternatively, the locking pin extends fully across the guide paths to fully block the design members from exiting through the guide paths 252A-B, 252C-D. The locking pins may be also adapted to extend through holes in latch 206A, 206B, for instance, in an alternate aspect, to releasably hold the latch in place. In such an embodiment, the locking member may be part of at least one latching member to enable the releasable latching of the latch. Further, the locking pin may be spring loaded, screwed, or inserted in any manner to cause the restriction to the design members. Further, FIG. 2B also illustrates at least one protruding member or traversing pin 248B (also protruding member or traversing pin 248A) provided adjacent to the first grooves or the second grooves in the wearable device. The protruding member 248B is provided to receive the latch 206A, 206B— and particularly to receive latching groove 244B, which enable releasable locking of the first section to the second section when the wearable device is worn. As the traversing pins or protruding members enable latching or locking of the first section to the second section, they are also referred to herein as latching members.

A person of ordinary skill would recognize that latch hinge 206C of the latch 206A, 206B allows the releasable locking or latching as the latch is fixed to one end of one of the sections—section 242A, while the corresponding protruding member 248B is on an end of another section—section 242B; however, the use of protruding members 248A and its corresponding latching groove 244A then provides a taut locking of the sections 242A, 242B. The taut locking maybe the case even if using a single latching groove in one end of a section to a single protruding member on another end of the single section having a single opening. Furthermore, an alignment protruding member 256 may be provided to couple with an alignment groove for purposes of aligning ends of the section prior to engaging the latching groove with the corresponding protruding member.

FIG. 2C illustrates, in example schematic 280, the sections 242A, 242B with a locking mechanism 106 of aspects of the wearable device with exchangeable parts in accordance with the present disclosure. As with FIG. 1, FIGS. 2A-C may be of the same or similar wearable device as in FIG. 1. FIG. 2C provides more detail of the exchangeable parts or design members 288A-D and its fit into the wearable device. A first section includes first grooves 284A, 284B. Groove 284B is provided only for illustrative purposes as a corresponding groove on the other side of the section that is hidden in the view (and therefore in broken lines). Moreover, the alignment of the grooves 284A, 284B are uniform to enable them to function as a rail path for the exchangeable parts or design members 288A-D. Similar grooves are in a section. FIG. 2C illustrates one exchangeable part or design member 288A being placed into the wearable device via guide path 252A, 252B (FIG. 2B) using rail supports 290A, 290B extend from the exchangeable part or design member 288A as an added feature or part of a unibody design member. The rail supports 290A, 290B slide through notches, which is part of the guide path 252A (also 252B) in a frame of the wearable device, and into the grooves forming the rail path for the exchangeable part or design member 288A. Other exchangeable parts or design members 288B-D are inserted in a similar manner.

Figure 3A:
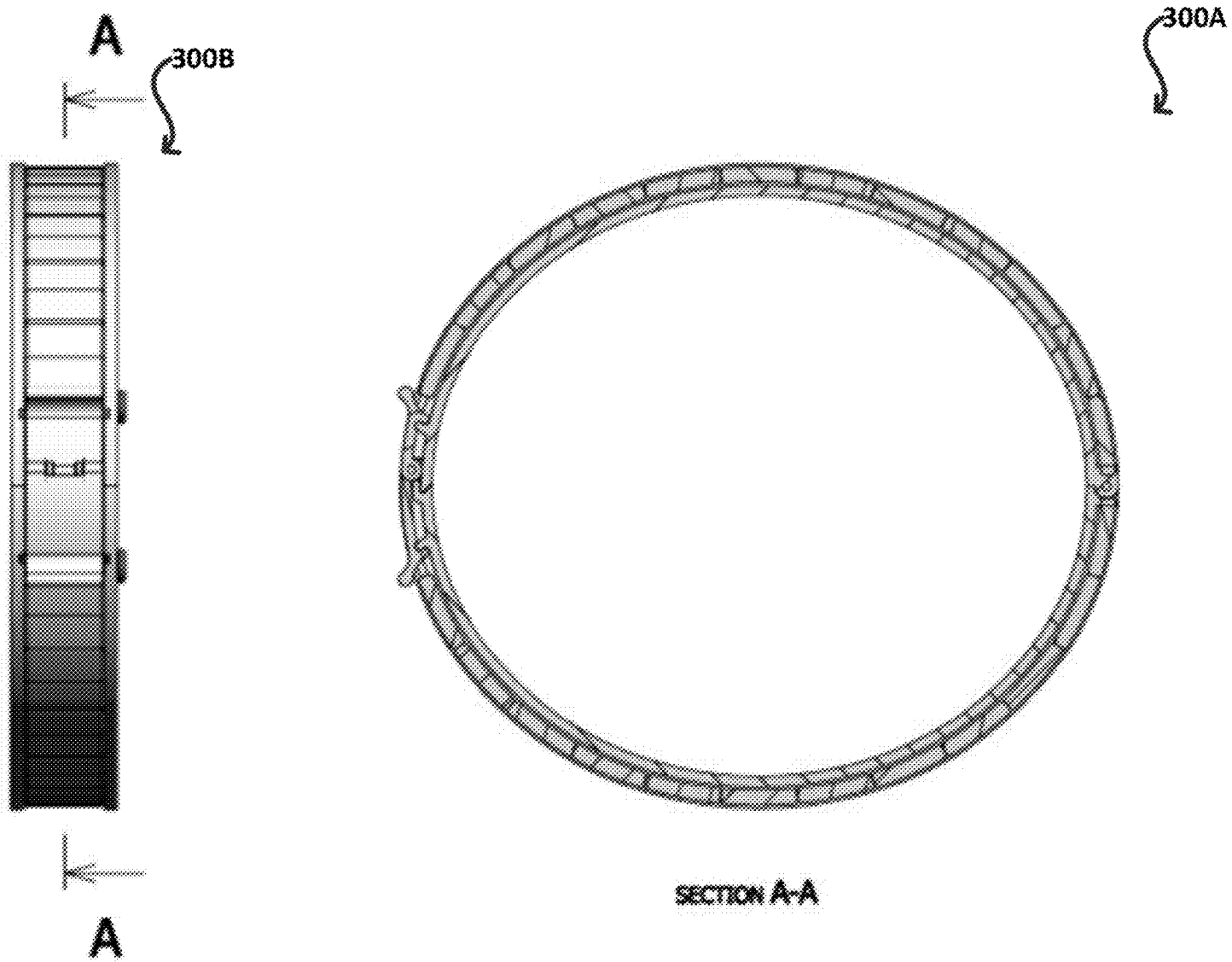
FIGS. 3A, 3B, and 3C are also detailed views of the wearable device with exchangeable parts, as in FIG. 1, in accordance with an aspect of the present disclosure.
Figure 3B:
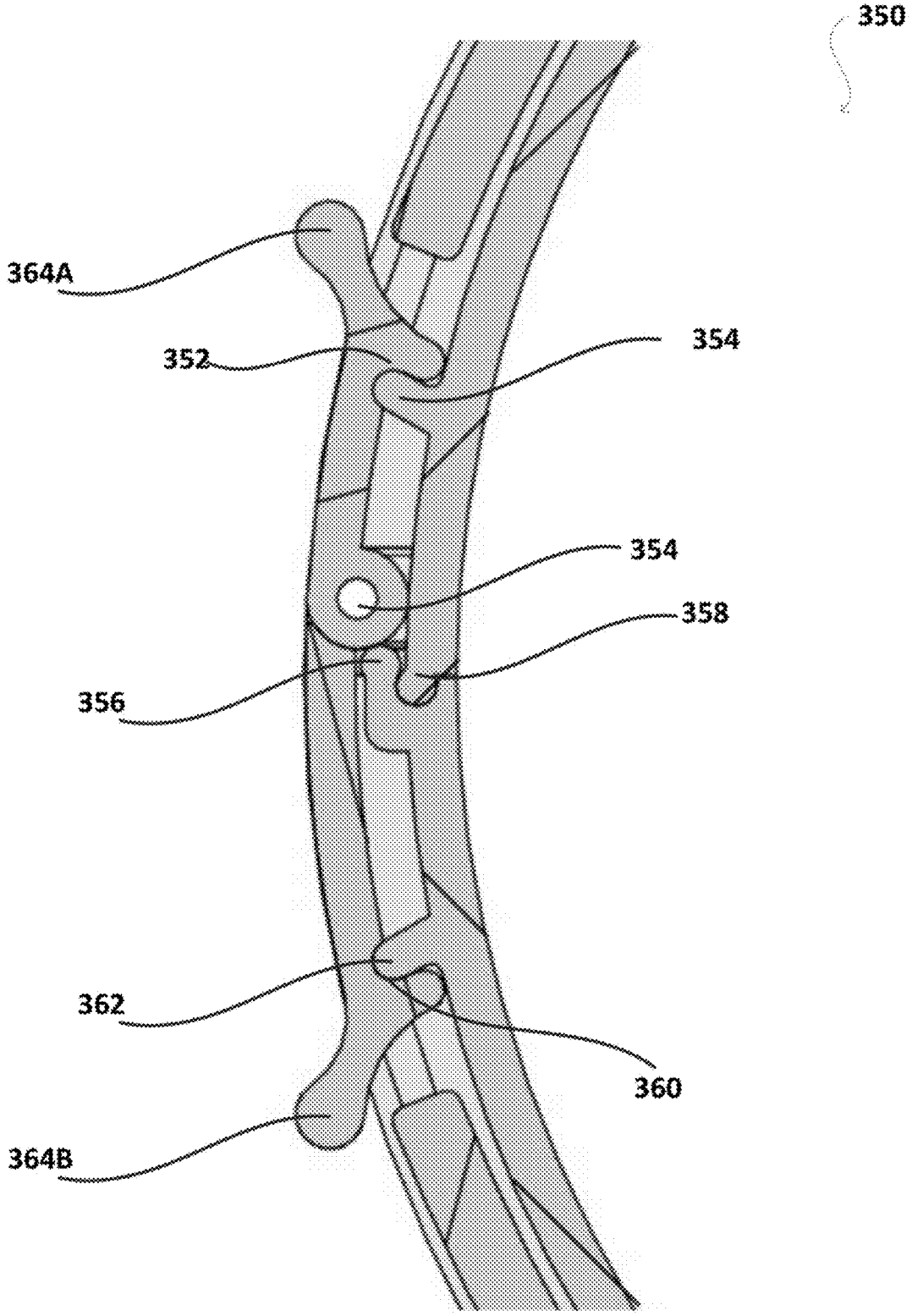
Figure 3C:
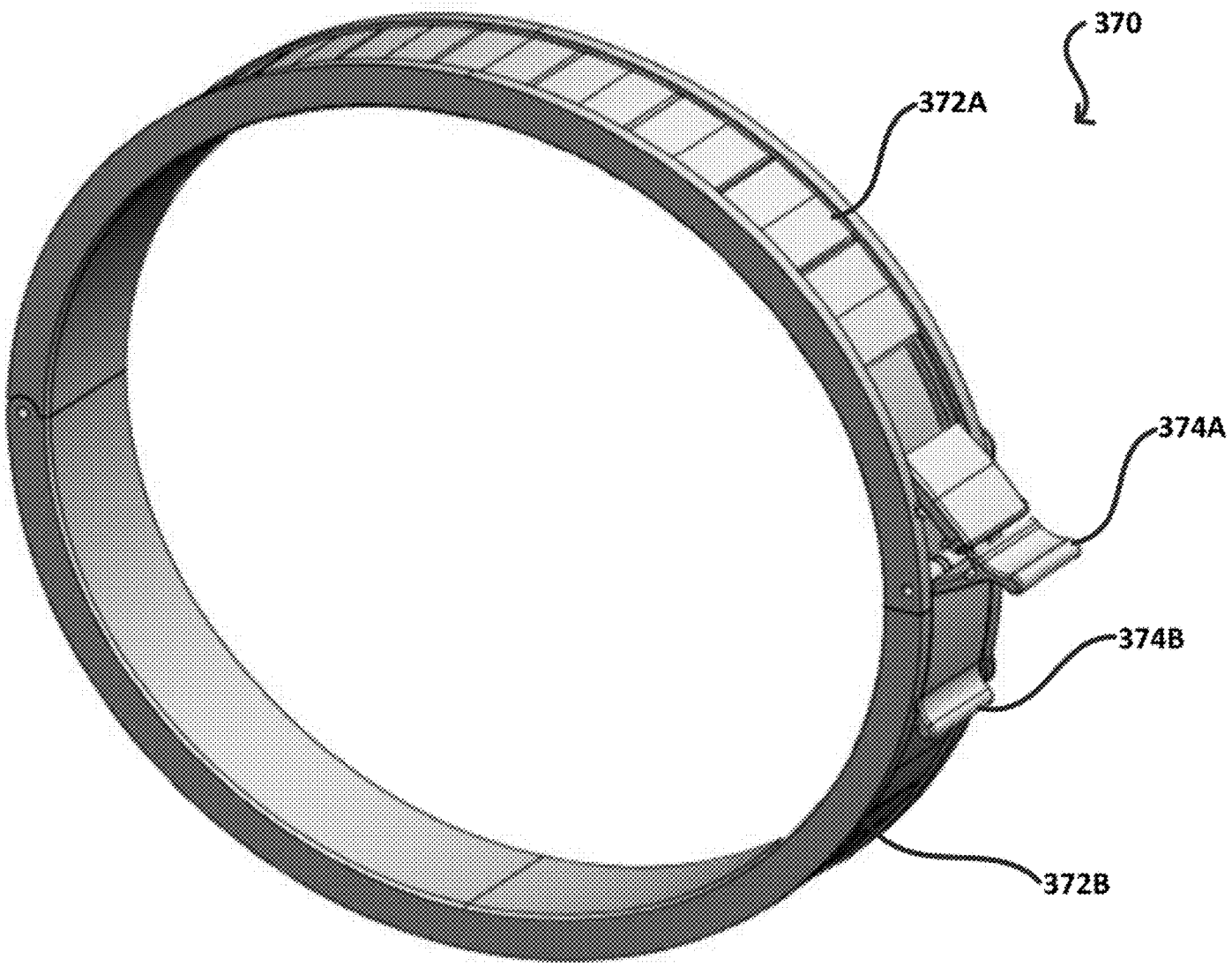

FIGS. 3A, 3B, and 3C are example schematics 300A, 300B, 350, 370, as well as detailed designs, providing further detailed views including of cross-sectional aspects of the wearable device with exchangeable parts in accordance with the present disclosure. A person of ordinary skill would recognize that these schematics offer different views of a same or similar wearable device as in FIGS. 1 and 2A-C. FIG. 3B provides a close-up cross-sectional view or schematic 350 showing the alignment protruding member 356 being coupled with an alignment groove 358. Latch hinge 354 provides relative movement of portions of the latch, but a person of ordinary skill would recognize that a single latch may be used in the place of the illustrated example, with the single latch hinged on one end of a section and enabled to engage a traversing pin on another end of the same or a different section of the wearable device.

FIG. 3B illustrates designed gripping surfaces 364A, 364B for releasing the latch from its locked or latched position, where protruding members 354, 362 hold in place corresponding latching grooves 352, 360. As illustrated, the grooves are angled to resist unlocking of the latch by accidental knocking of the gripping surfaces 364A, 364B. The angle would be readily understood to a person of ordinary skill reviewing the present disclosure and the many associated figures. FIG. 3C illustrates an angled schematic or view 370 of the wearable device showing a design member being inserted through the guide path into the rail path formed by opposing grooves of the internal sections 372A, 372B of the wearable device. In FIG. 3C, one side of the latch (or one independent latch) is engaged via the gripping surfaces 374B being engaged (e.g., pressed in) so that an underlying protruding member is engaged with an underling latching groove. Another side (or another independent latch) is not engaged, but allows for the insertion of new design members, after which it may be engaged using gripping surfaces 374A.

In all of the figures of the present disclosure, the wearable devices may be used as a bracelet, anklet, ring, pendant, necklace, earring, nose-ring, watch, and other wearable products—with exchangeable parts. In addition the exchangeable parts may include static design members—such as charms with characters, letters, numbers, etc., and may include dynamic design members—such as electronic and/or mechanical devices with digital or analog display capabilities. For example, digital letters, mechanical pieces, etc., may be mixed with letters and with jewels to form a fully personalized wearable device. A person of ordinary skill would be able to mix and match based on the embodiments, which may also be combined with each other.

Figure 4A:
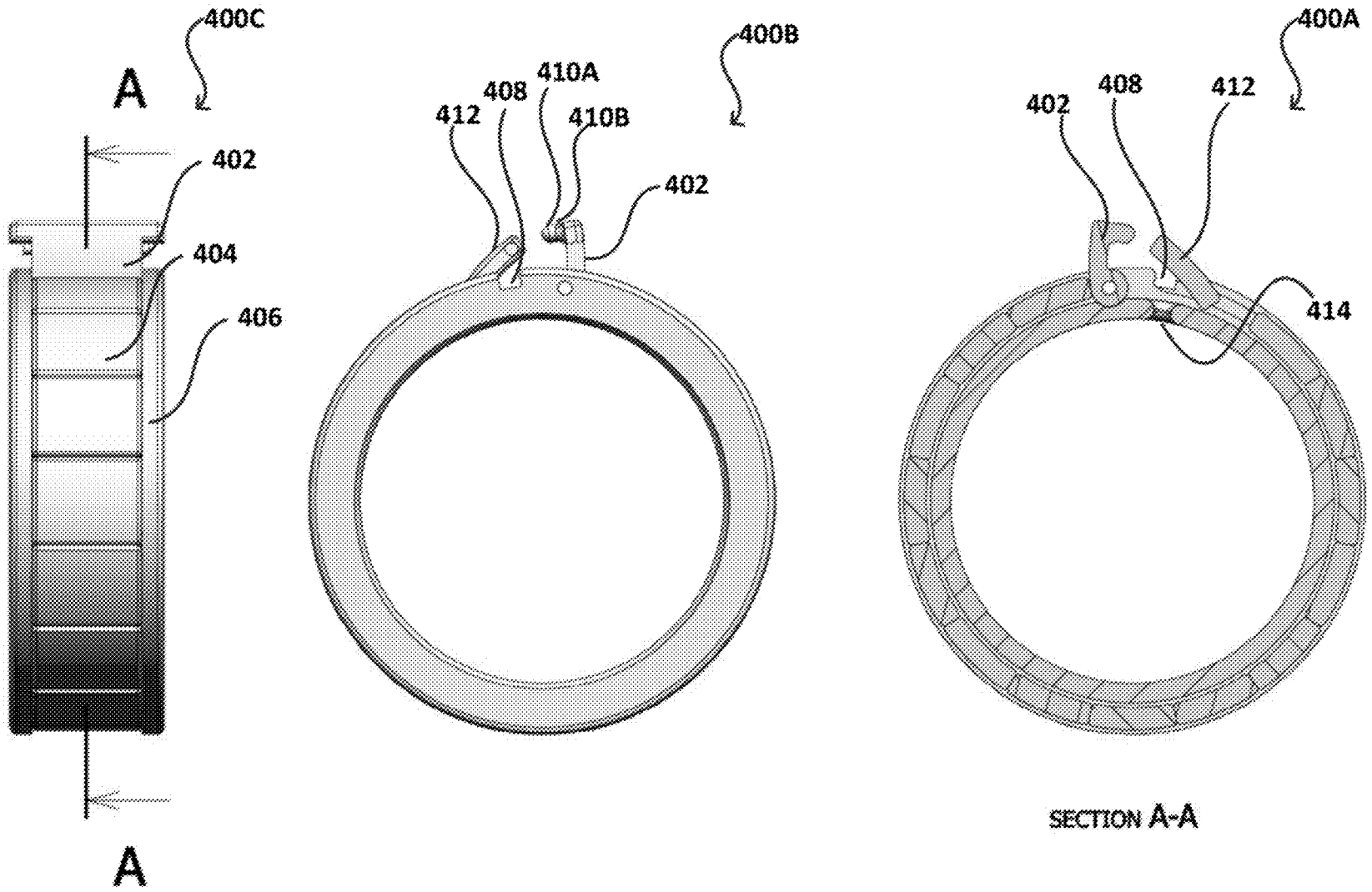
FIGS. 4A and 4B are different views of another wearable device with exchangeable parts in accordance with an aspect of the present disclosure
Figure 4B:
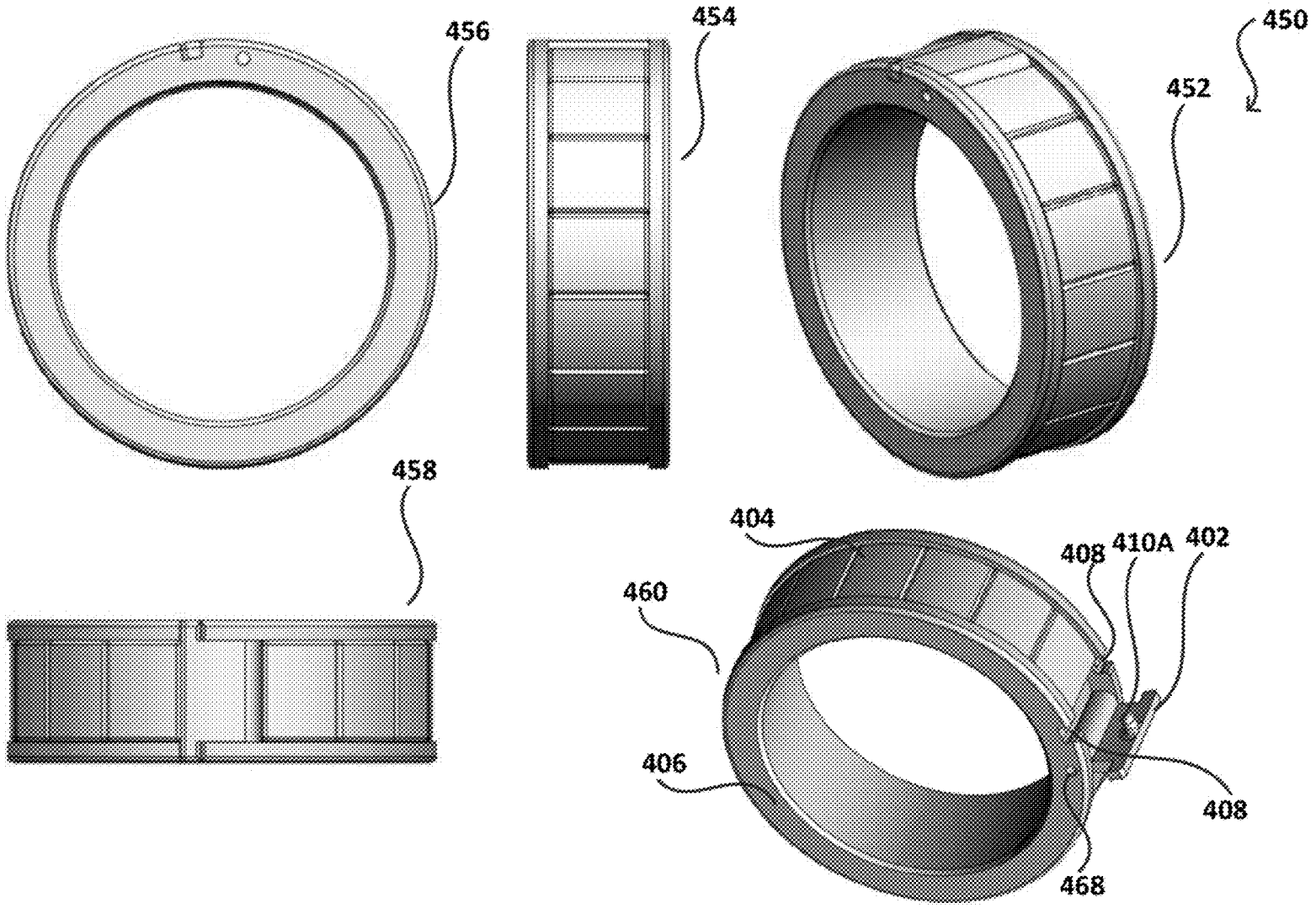
Figure 4C:
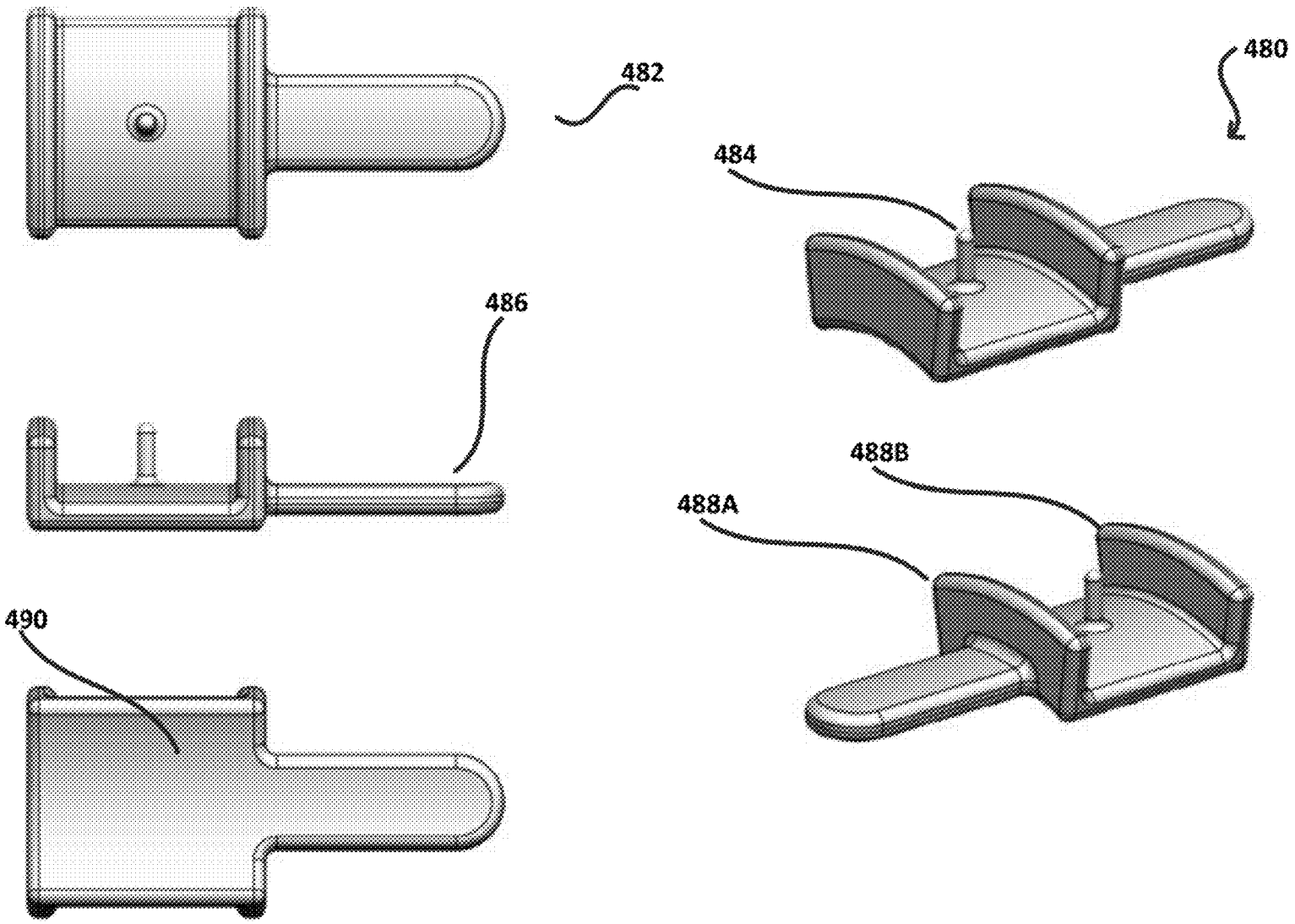
FIG. 4C is a keys that may be used with the wearable device of FIGS. 4A, 4B, in accordance with an aspect of the present disclosure.

FIGS. 4A, 4B, and 4C are example schematics 400A-C, 450, 480, as well as detailed designs, providing alternative aspects with detailed and cross-sectional views of a wearable device having exchangeable parts and associated keys that may be used with the wearable device, in accordance with the present disclosure. FIGS. 4A-C illustrate a single section having a latch 402, guiding path 408, rail paths, design members 404, 412 inserted into a frame 406 of the wearable device in the same or similar manner (through the guiding path, for example) as in FIGS. 1, 2A-C, and 3A-C. The alternative aspect in FIG. 4A allows for use of a latch 402 that includes a latching or locking pin 410A. The latching or locking pin 410A (forming a locking member) has a circumferential groove 410B to interlock, at least partially, into a latch port 414 of the section. The locking member enables the design members to be locked inside the frame 406. The latch port 414 is illustrated as having a narrowing or ridging area for the latching or locking pin 410A and so the latch portion with at least the narrowing or ridging feature provides the latching member for holding the latching or locking pin of the latch and enables releasable locking of the latch 402; 410, and to close the opening. When multiple sections are included, then the latch pin may be on section latching into a port formed in another section. The latching in the latching member is releasable, but when latched, the design members may be retained in place in the section by virtue of the latching or locking pin forming the locking member, as well as—when sections are available on the wearable device—i.e., when the sections are locked together. FIG. 4B illustrates further various schematics or views 450 of a ring or other wearable device 452-460 having the design members 404, latch hinge 468, the frame 406, the latch 402 with latching pin 410A, and guiding paths 408.

FIG. 4C illustrates various views or schematics 480 of a key 482 that works with the ring or other wearable device 452-460. In the example of FIG. 4C, the key has guide features 488A, 488B to position the key under the ring, and has counterlock pin 484 that presses into the port when the latch 410 is in locked position. In this manner, the counterlock pin 484 pushes out the latch pin 410A to unlock the latch 402. Grip surfaces 486, 490 are provided for positioning and energizing the key 482 to unlock the latch for the alternative aspect of this disclosure.

Figure 5A:
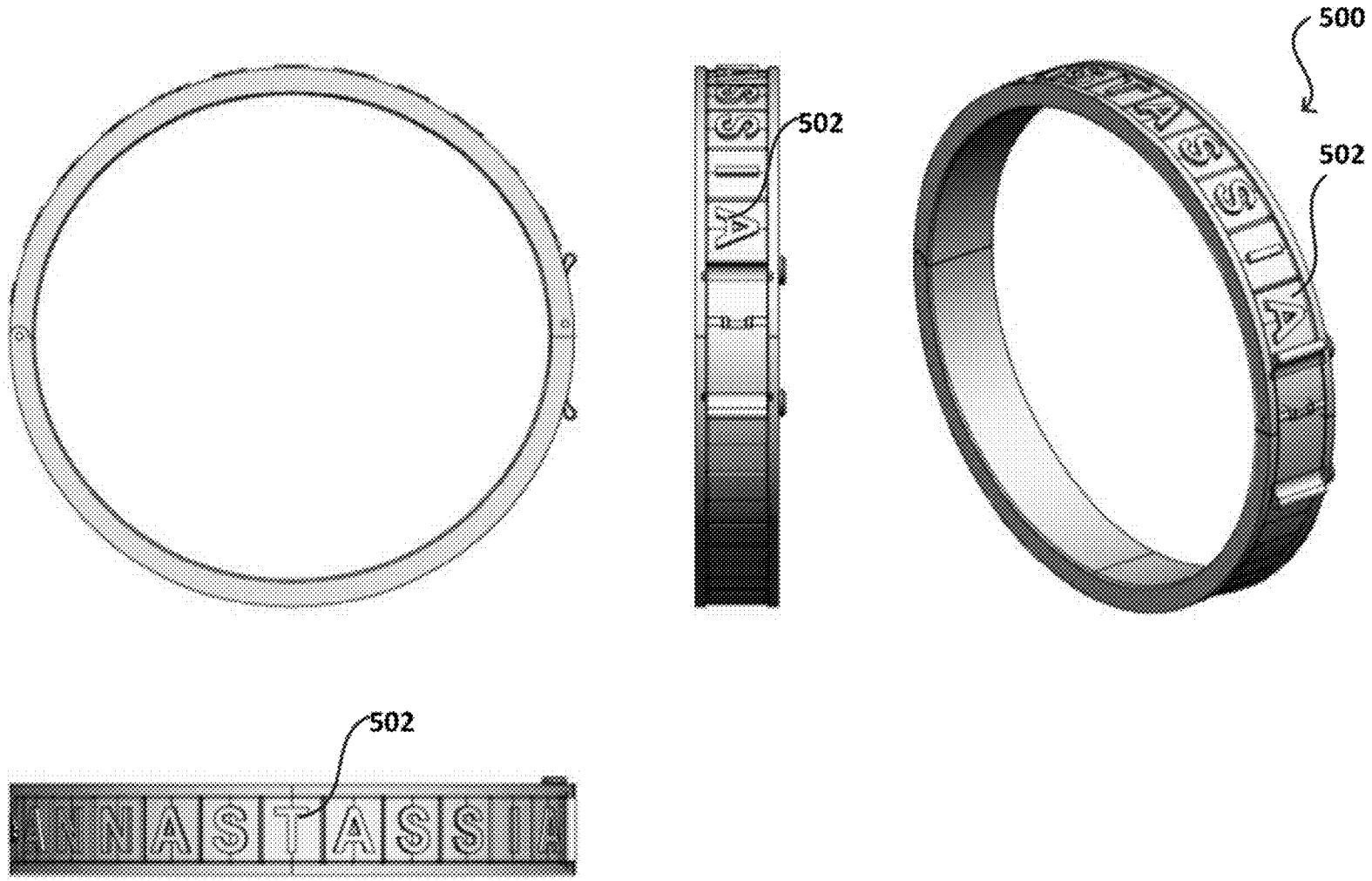
FIGS. 5A, 5B, and 5C illustrate details of exchangeable parts available to the wearable devices of FIGS. 1-4B, in accordance with aspects of the present disclosure.
Figure 5B:
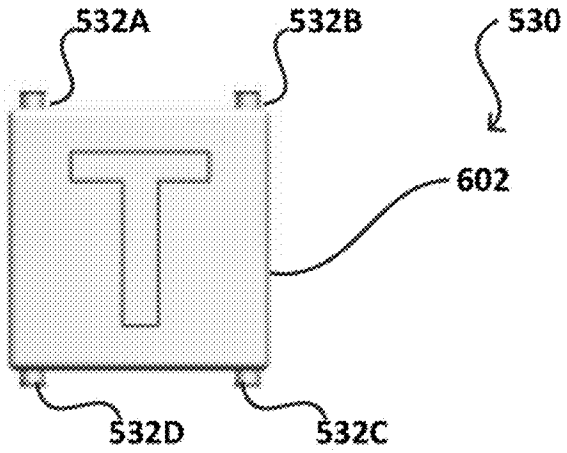
Figure 5C:
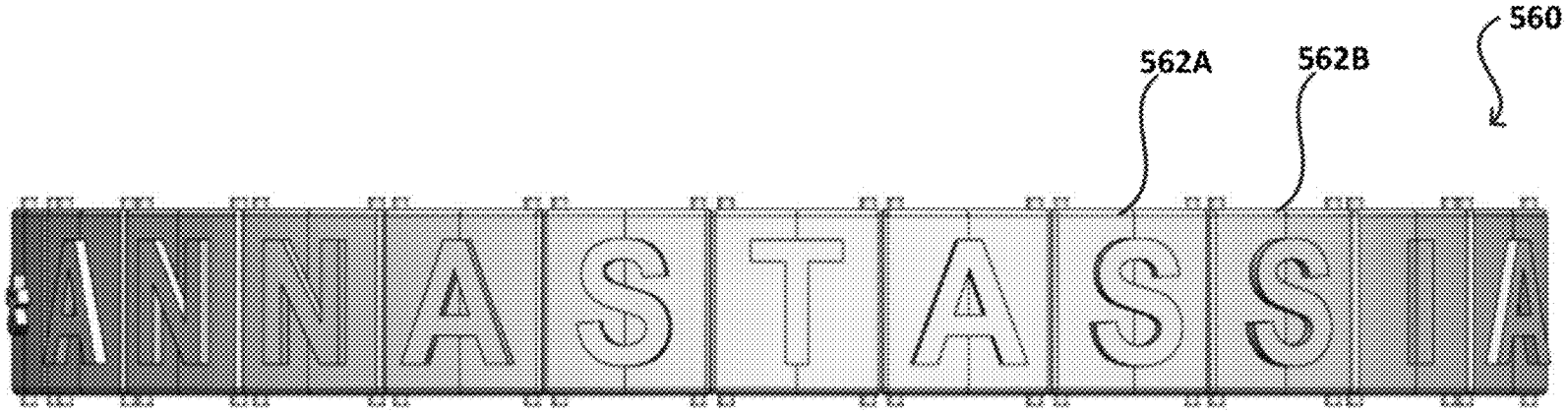

FIGS. 5A, 5B, and 5C are example schematics or views 500, 530, 560, as well as detailed designs, providing views and details of exchangeable parts 502 available for the wearable device in accordance with the present disclosure. Rail supports 532A-D are illustrated in FIG. 4B to guide the design members or exchangeable parts 502 into the guide path and the rail path of the frame of the wearable device. Instead of separately identified rail supports, the rails supports may be integrated as a thinner portion at the edge of a design member and may extend along an entire edge. Other forms of rail supports, including bumps and other shapes may be used instead of rail supports 532A-D. Further, the design members may be placed closed together or with a designed gap in between as illustrated with design members 562A, 562B. The illustrated design members of FIGS. 5A-C may be made of precious material, may include jewels, may include letters, characters, and any other design elements, and may be sold separately or together as a set with the wearable device. In addition, these static design elements maybe exchanged for dynamic design elements such as including a watch surface (smart device including a display) and a smart module—showing or interfacing with a smartphone, for instance. Such a dynamic design element may change information displayed or colors when used, and may be used to notify users of any notifications appears on a corresponding (paired) smart device.

FIGS. 6A, 6B, 6C, and 6D are example schematics 600, 620A, 620B, 640A-C, and 680, as well as detailed designs, providing alternative aspects including detailed and cross-sectional views of aspects of a wearable device with exchangeable parts in accordance with the present disclosure. The design members 602A, 602B are illustrated as separate characters entirely, and not as blocks having characters on them. Here too, a hinge 604 may join two separate sections of the wearable device; but a single section may be used instead. The example of FIG. 6A includes a single latch 606 and guide paths 604, as in the case of the examples of FIGS. 1, 2A-C, 3A-C, 4A-C, and 5A-C.

Figure 6A:
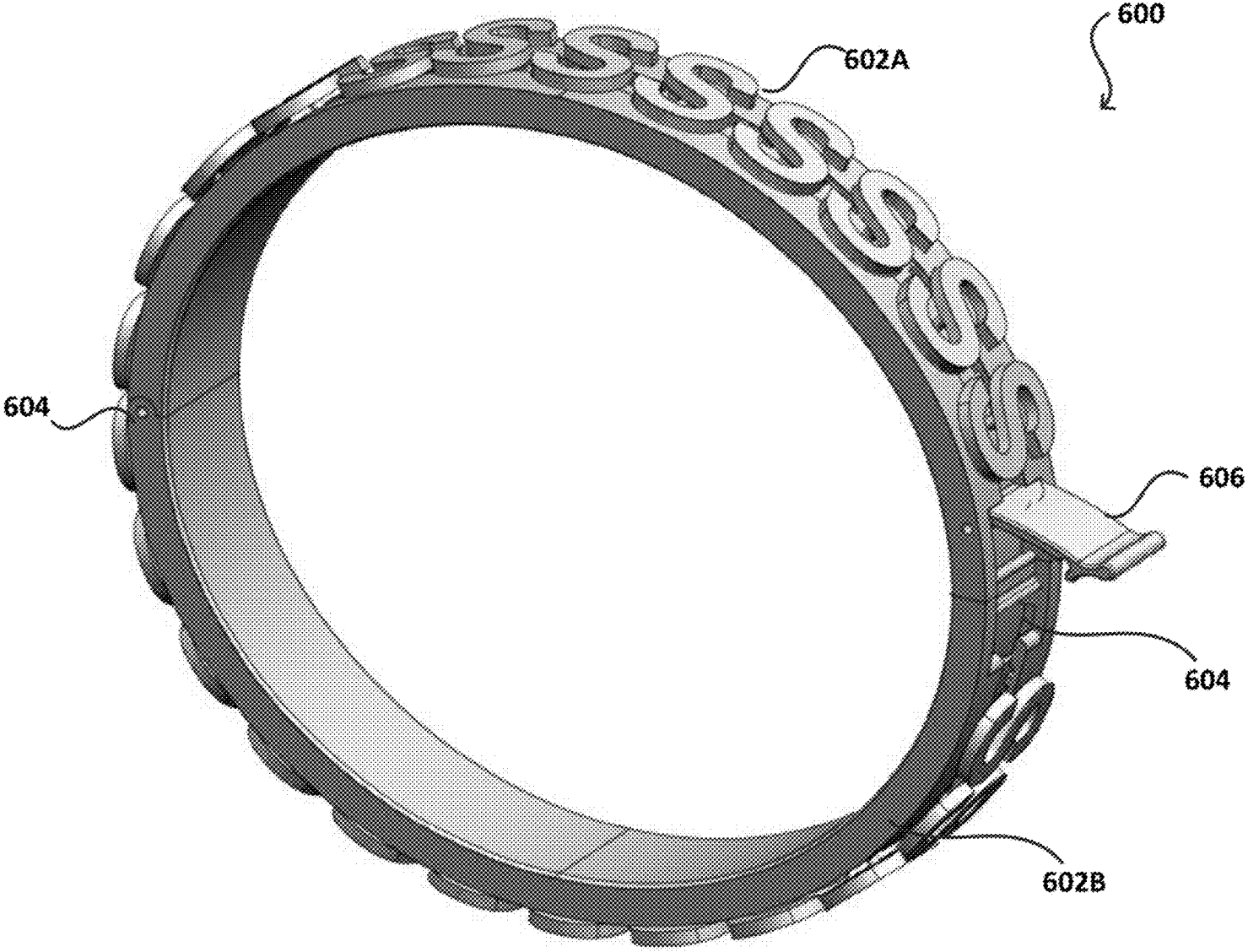
FIGS. 6A, 6B, 6C, and 6D are different and detailed views of yet another wearable device with exchangeable parts, in accordance with an aspect of the present disclosure.
Figure 6B:
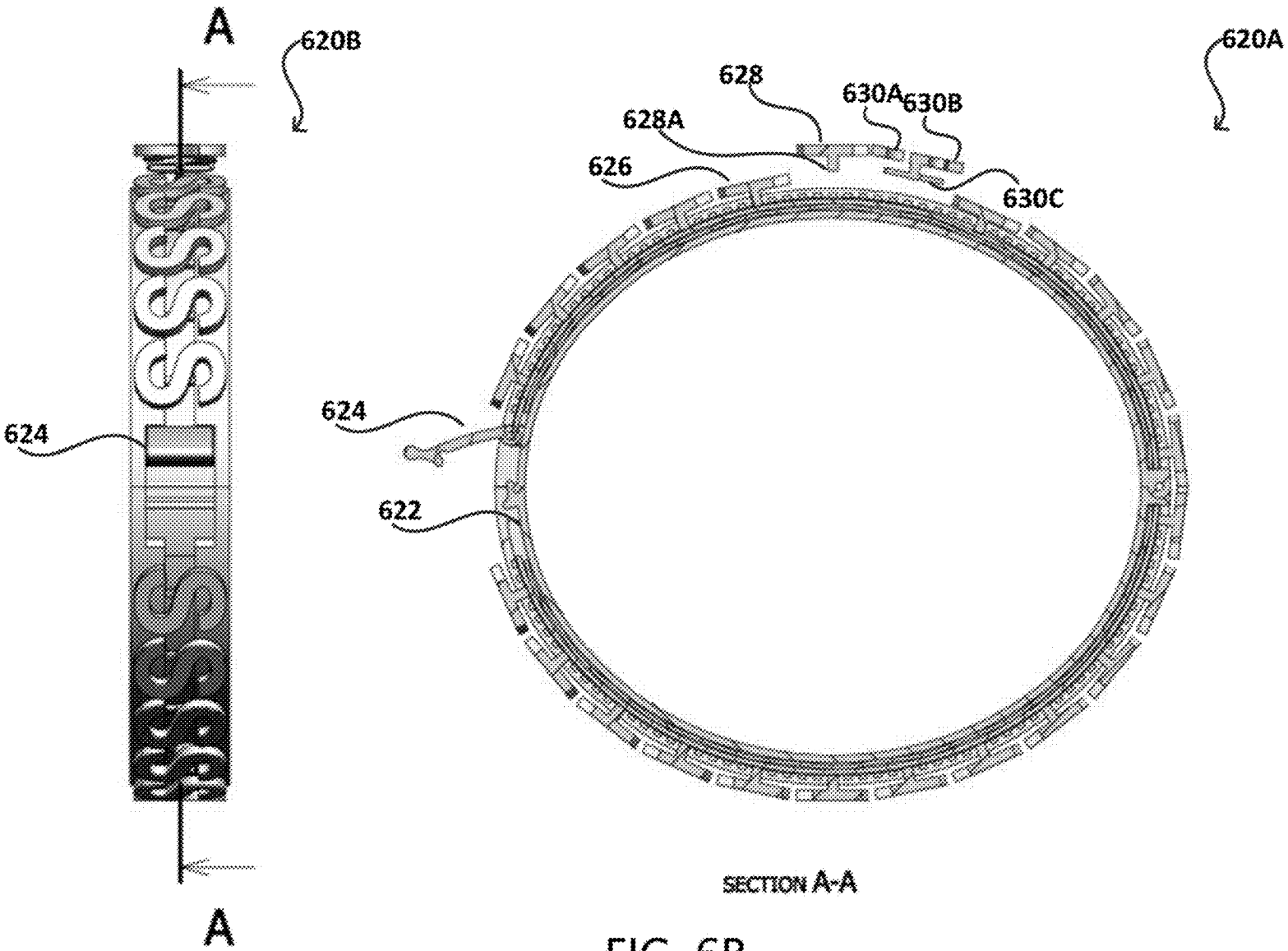

FIG. 6B, however, illustrates alternative aspects for the exchangeable parts, allowing the parts to be turned and inserted into position, for instance. In the view or schematic 620A, design members 626, 628 are illustrated having interlock members—e.g., interlock member 628A. The design members may also be separate parts 630A, 630B that are joined together in a releasable manner. Interlock member 630C allows is available to place the design member in its place with the wearable device of FIG. 6B.

Figure 6C:
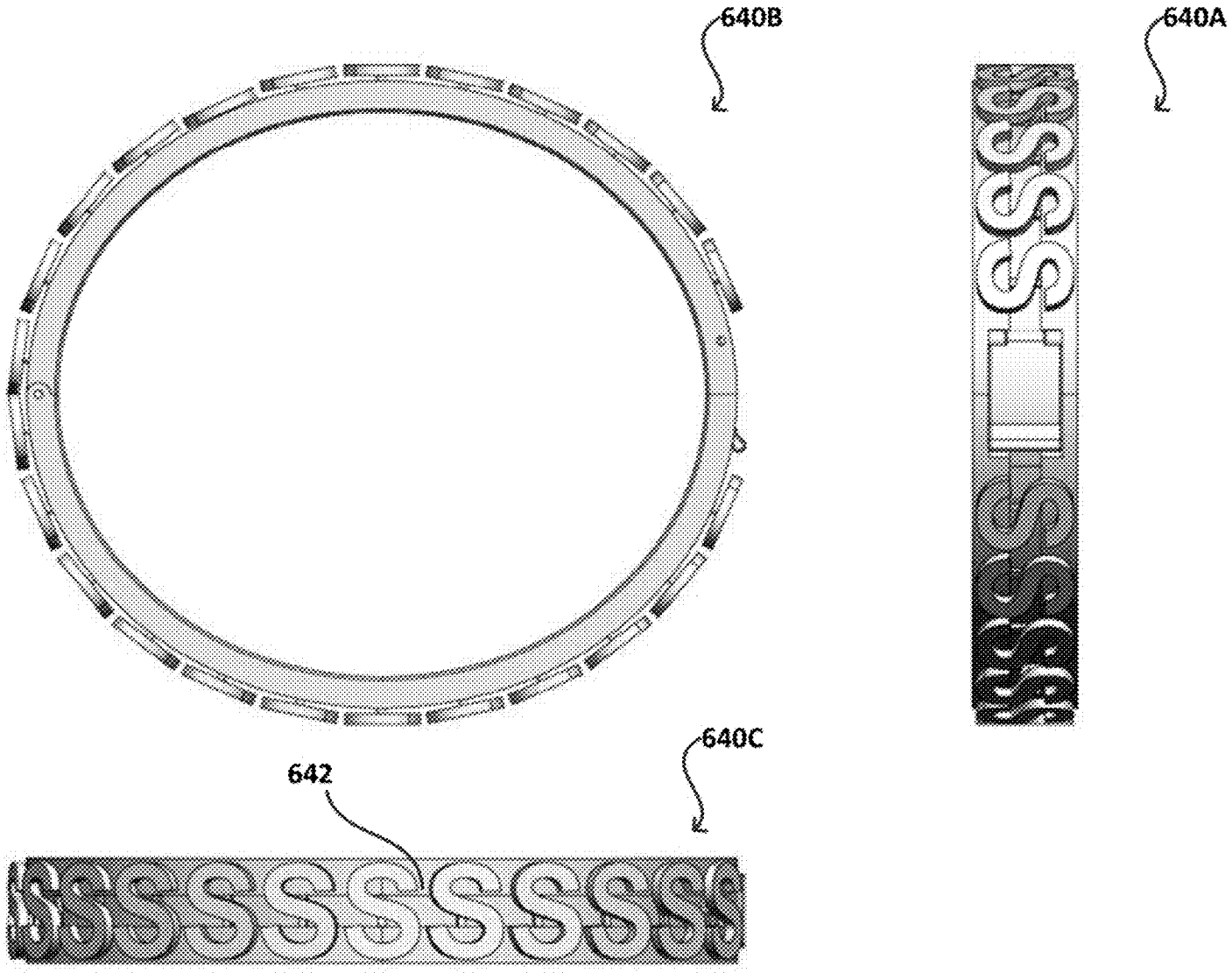

FIG. 6B illustrates latch 624 for locking the sections and an underlying guide path 622 for moving the design members into place. FIG. 6C illustrates further views or schematics 640A-C of the design members and the wearable device. The guide path 642 is a top view of the cross-sectional guide path 622 from FIG. 6B. Here, different from the rail path, the guide path accepts and guides the design member till it is ready for fixing in a specific location. The rail path provides a path for movement but as the fixing is by a locking pin adjacent or on the guide path, the rail path may be distinguished in this manner for reference purposes unless indicated otherwise. Presently, in the embodiment of FIG. 6B, the guide path 622 (also 690) relies on locking pin, such as an interlocking member or including an interlocking member, as part of or attachment to the design member. As such, for this embodiment, the locking pin is used interchangeably with the interlocking member of the design member. As in the case of the embodiments in FIGS. 1, 2A-C, 3A-C, etc., the interlocking member or locking pin is adjacent to the guide path 622 (also 690) and enables locking of the design members in an intended position in the wearable device.

Figure 6D:
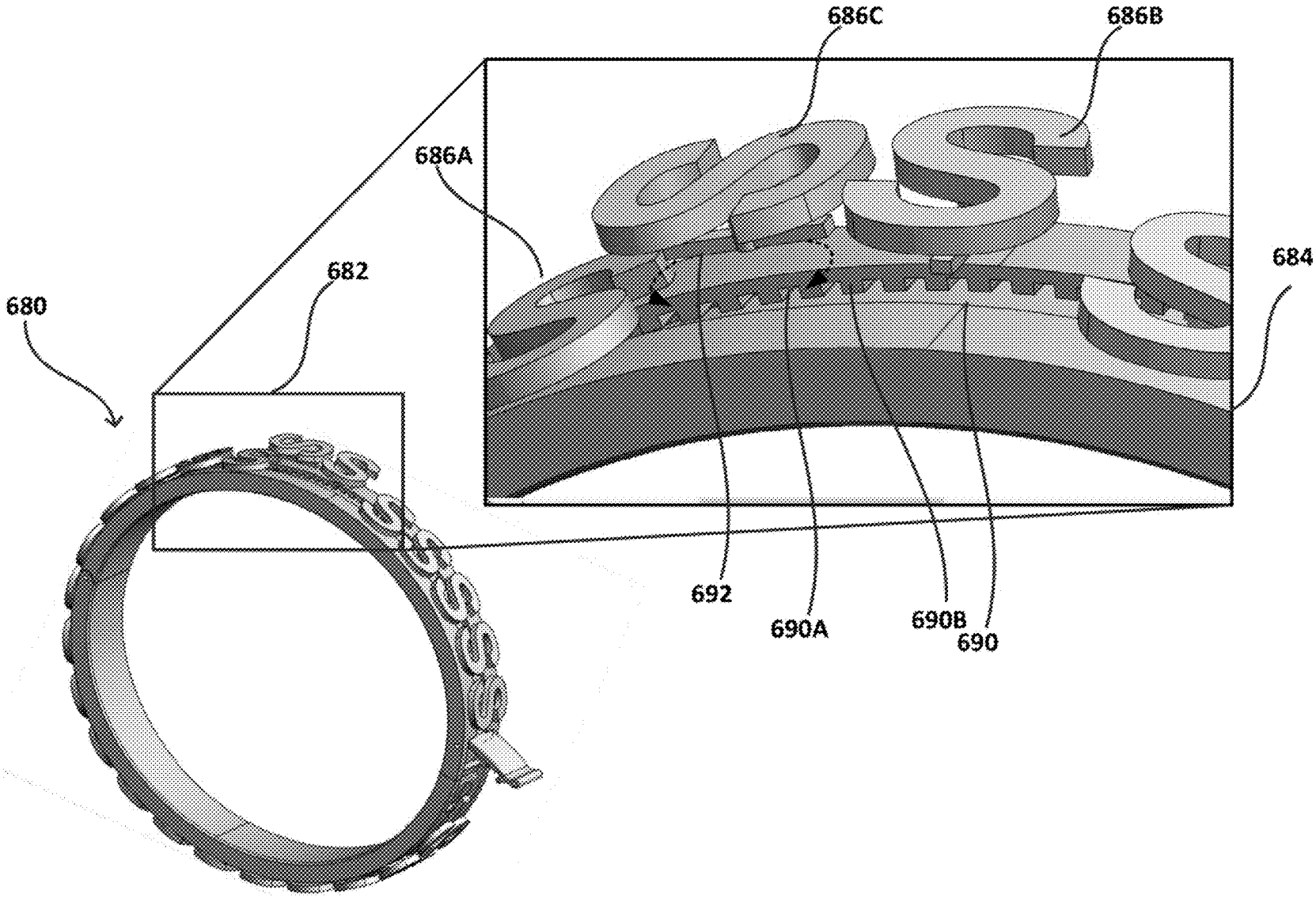

FIG. 6D illustrates a schematic or view 680 with a blowup view 684 of section 682. In the illustration of FIG. 6D, the design members 686A-C are illustrated, with one design member 686C being put in place in the guide path, while one design member 686A is already in place, and another design member 686B is out of alignment for the placement in the guide path. The guide path includes grooves having crests 690B and troughs 690A (one set of a crest and a trough is marked and referenced in the figure). As illustrated, the guide paths are angled relative to the grooves. A person of ordinary skill would understand that crests and troughs are also in an opposing side groove of the illustrated guide path (but not visible in the drawing). The interlocking member or locking pin 692 is inserted in to guide path 690 so that the interlocking member 692 has its longest edge parallel to the length of the guide path 690. This allows the interlocking member 692 to freely enter the guide path 690. Different from design member 686C, design member 686B has its interlocking member with the longest edge perpendicular to the guide path 690 and cannot be inserted into the wearable device. This is illustrative of the alignment required to insert and lock design members in the guide path 690. Once inserted into the guide path 690, the design member may be turned so that the interlocking member fits into a corresponding trough 690A.

In an example, interlocking member or locking pin 692 may be a type of leaf spring that is configured to bend at free edges on either side of the interlock member 692 (see e.g., interlocking member 630C of FIG. 6B. The interlocking member 692 may have its edges at a natural upward curled position. As a result, the interlocking member 692 may be pressed into the guide path 690, which causes the edges of the interlock to change curve (e.g., downwards) and to bend under the crests 690B and to be positioned into the troughs 690A. In this example, the fulcrum may be at the center of the interlocking member 692, with a bump beneath the fulcrum. The bump may contact the guide path 690 and cause edges of the interlocking member 692 to bend downwards. The interlocking member 692 may be rotated in this pressed configuration so that it clears the crests 690B and when aligned to a desired trough 690A, it may be released, which causes the edges to take its natural state—e.g., curved upwards and interlocking into the trough 690A. A person of ordinary skill, reading the present disclosure, would recognize that the trough 690A refers to a portion of the groove in the guide path 690 that has lower physical aspects than an adjacent section, referred to as a crest similar to a wave, and that the trough is, therefore, capable of retaining the interlocking member 690.

Alternatively, the interlocking member 692 is attached to the design member 686C by an internal compression spring or an internal spiral torsion spring. External springs may be used as well. In this example, the interlocking member 692 may pressed to activate the spring, so that it may be aligned into a guide path of the wearable device, and so that it may be fixed to the alignment by releasing the activation on the spring. The activation may be a compression pressure or force or a rotational pressure or force. For example, when a spiral torsion spring is used, legs of the spiral torsion spring may within each of the two edges of the interlocking member 692. The center of the spiral torsion spring may be fixed in the center of the design member to provide a fixed point around which the legs may be moved. As such, the two edges of the interlocking member 692 may be brought parallel by pressing the edges towards the same direction to activate the spiral torsion spring. A flat spring and a helical torsion spring may be alternatively used in a similar implementation and will be readily understood to a person of ordinary skill in the art. The guide path 690 is provided with sufficient breadth to allow the width of the two edges of interlocking member, when brought together, to be lowered into the guide path 690. Once in the guide path, the edges may be released into the appropriate troughs 690A for positioning the design member 686C. Further, there is no need for the guide path 690A to have clearance below the crest 690B, although having the clearance may not affect the intended function of the spring.

In a further example, the interlocking members may be screwed to the deign member such that once the interlocking member is within the intended trough, then turning the design member engages the interlocking member to screw into the design member. As the upper portion of the design member providing the character is of larger dimensions than the guide path 690, the screwing of the interlocking member in the trough to the design member then locks the design member in the position. In this alternative, there may not be a locking pin as the interlocking member, by virtue of the screwable format, forms the locking pin. In a further alternative implementation, the interlocking member may rely on spring loading with the design member, or a push-press locking mechanism with a groove lock that is pressure activated to fix the design member in place, instead of the screwable format.

Figure 7:
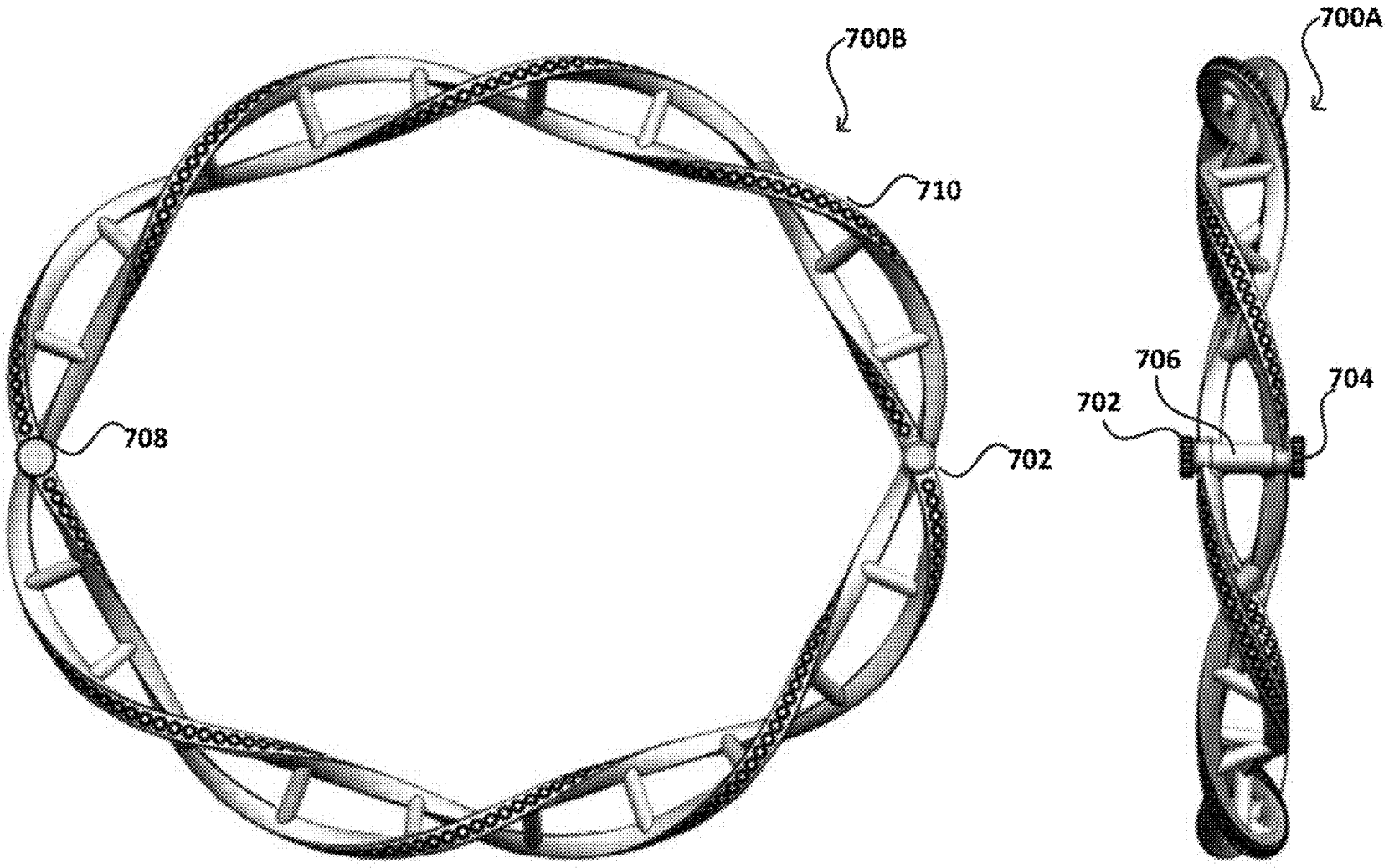
FIGS. 7 and 8 are different views of still another wearable device with exchangeable parts, in accordance with an aspect of the present disclosure.
Figure 8:
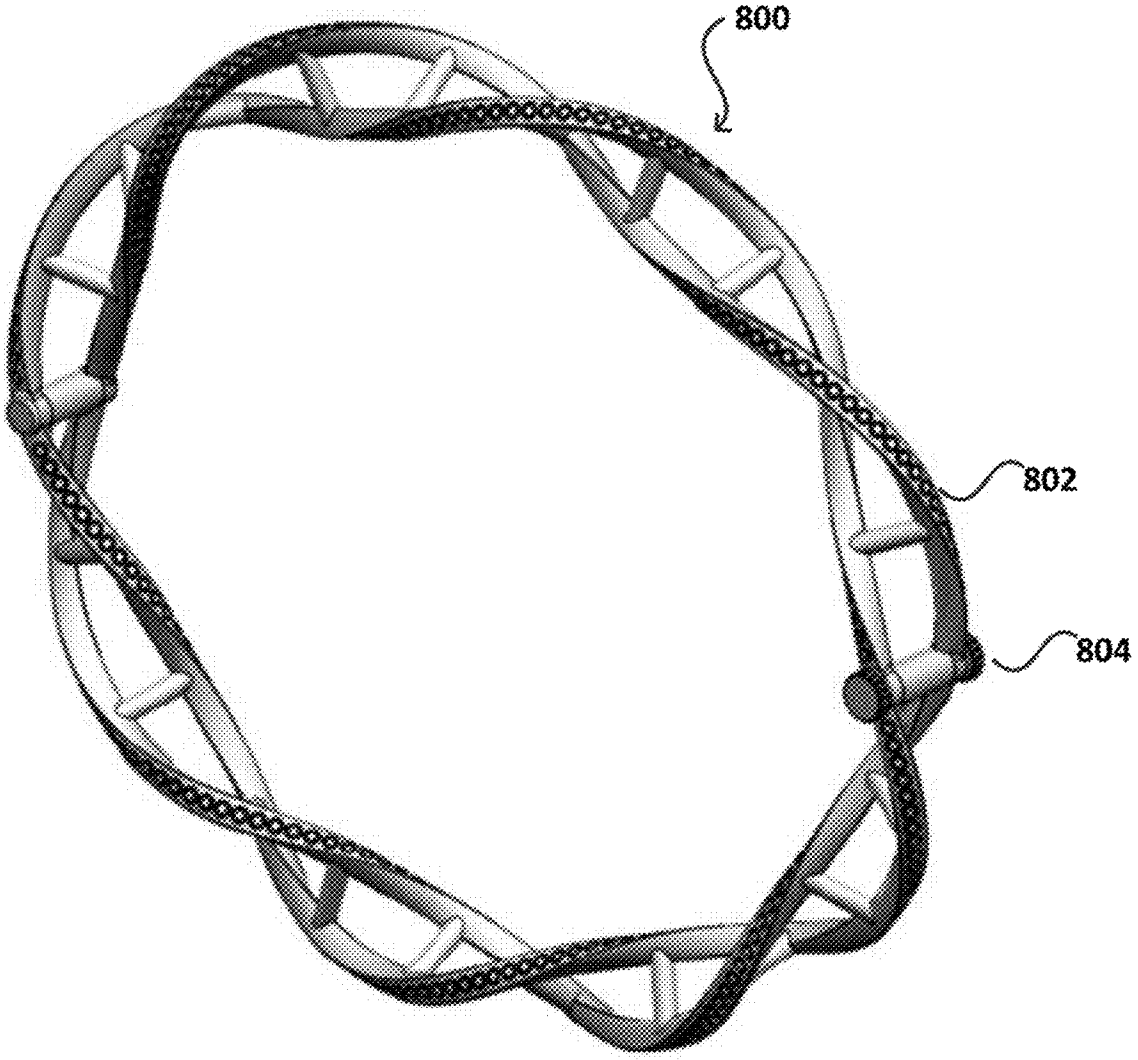

FIGS. 7 and 8 are example schematics 700A, 700B, 800, as well as detailed designs, providing aspects of closure systems 702 and designs for a wearable device with exchangeable parts in accordance with the present disclosure. The example of FIG. 7 provides views or schematics 700A, 700B of a gene or strand jewelry or wearable device having areas for jewelry or design member placement on its individual strand areas 710, having a hinge 708, and having a locking or closure system 702. The design members in the strand areas may be provided in a similar manner discussed with reference to one or more of FIGS. 1, 4A, 4B, and 6A-6D. For instance, the design members may be slipped in through a guide path to grooves in the twisted strands as in the example of FIGS. 1, 4A, and 4B, with the guide path restricted by the locking member 702, 704 that latch with a tunnel 706 that forms a latching member for the present embodiment; or may be slipped in through the guide path to the areas and held in place by an underlying locking member in the manner of the example in FIGS. 6A-6D. The locking members 702, 704 include additional length in the member, the additional length forming a latch to latch the tunnel 706. The closeness of the design members to each other enables the underlying grooves and guides to remain hidden from view. Moreover, at least one of the underlying grooves and guides may be covered by the latch or closure system 702 as in the case of the embodiments of FIGS. 1, 4B, and 6A. The closure system 702 includes locking pins 702, 704, as discussed elsewhere in this specification, from two ends, with a tunnel 706 for receiving the locking pins. The tunnel may be threaded, along with the locking pins 702, 704. In the example of FIG. 7, the tunnel is fixed on one end of a section (or of a first section), and the locking pins 702, 704 are fixed on another end of the section (or of a second section). The fixing may be mechanical—e.g., welding, or printed with the strand areas 710. FIG. 8 provides a further view or schematic 800 of the strands 802 and the closure or locking system 804. The strands 802 are provided with width to receive ornamental arrangements. Moreover, the ornamental design in FIG. 8 illustrates that the strands 802 extend in three dimensions (3D)— X, Y, and Z axes, and that the twists in the strands are also in the 3D axes.

Figure 9A:
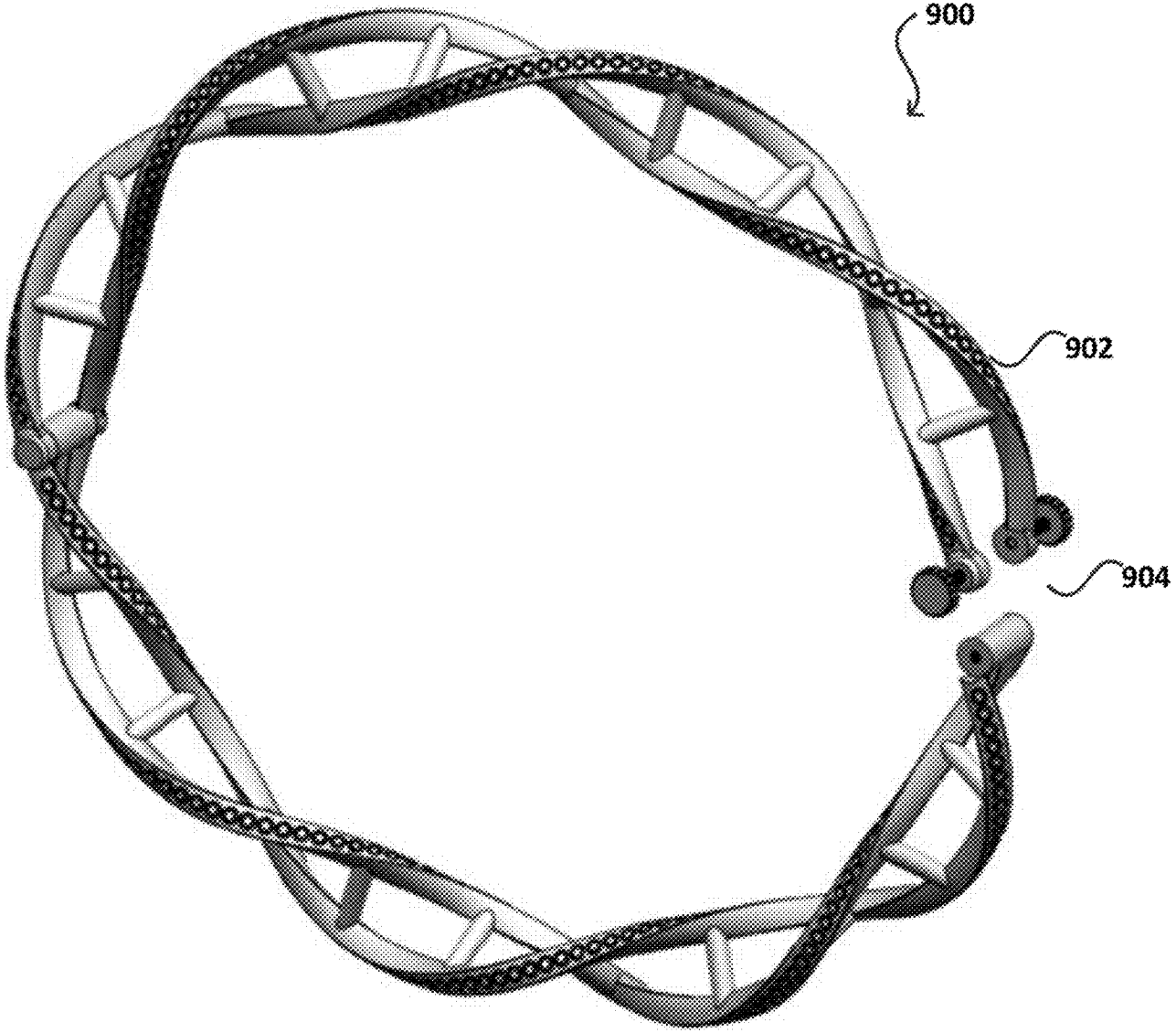
FIGS. 9A and 9B provide detailed aspects of closure systems and designs for a wearable device with exchangeable parts in accordance with the present disclosure.
Figure 9B:
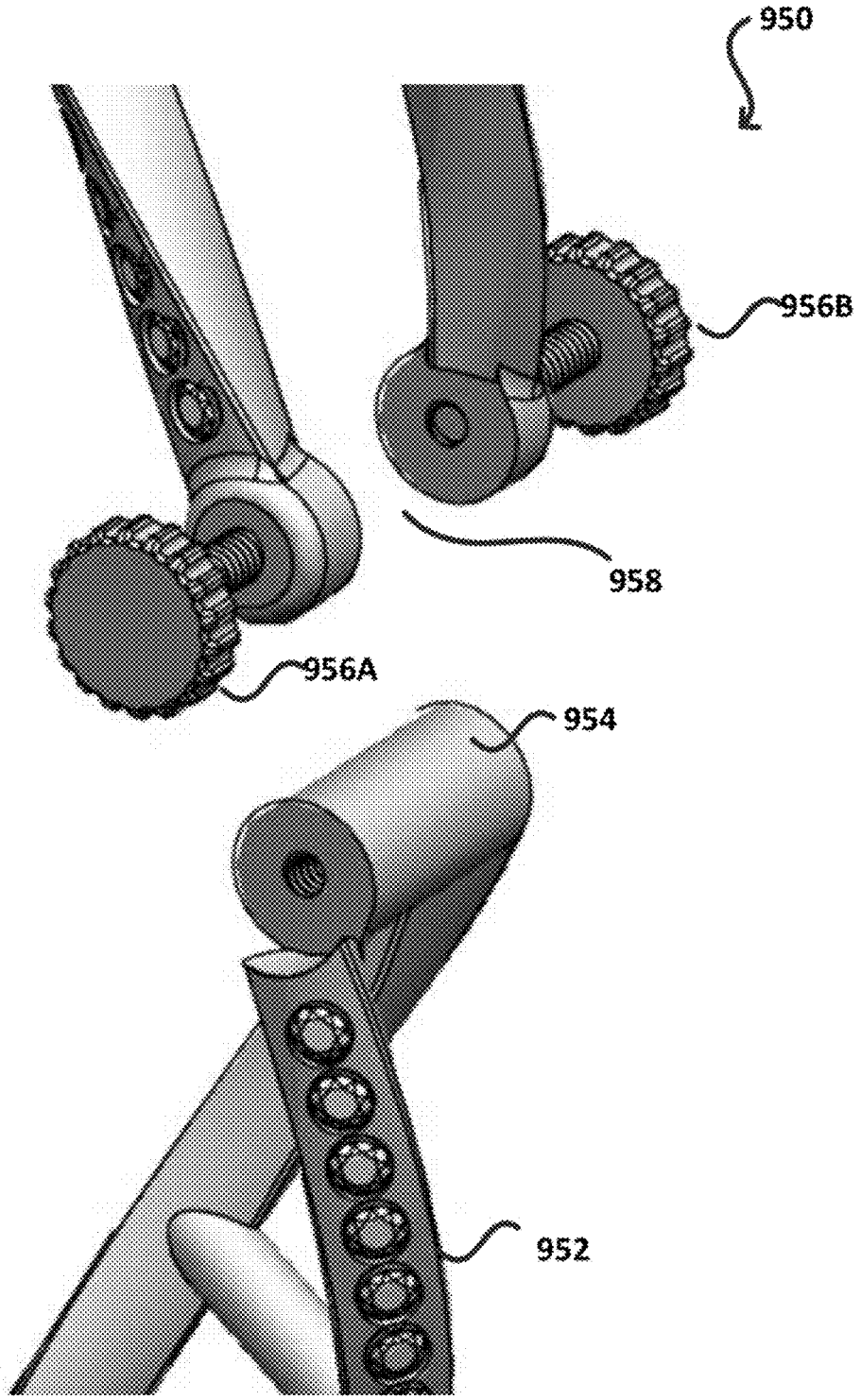

FIGS. 9A, and 9B are example schematics 900, 950, as well as detailed designs, providing detailed aspects of closure systems 904 and designs for a wearable device with exchangeable parts in accordance with the present disclosure. As in the case of FIGS. 7 and 8, the closure system 902 includes locking pins from two ends, with a tunnel for receiving the locking pins. The tunnel may be threaded, along with the locking pins. Alternatively, the locking pins are spring loaded and may be pulled apart to release from the tunnel for unlocking, and may be pulled apart and then released into the tunnel for locking. Alternatively, the locking pins include a circumferential groove to interlock with a receiving protruding member within the tunnel—e.g., a decreased (or narrowing) circumferential cross-section provided, for example, by a ring within the tunnel. The circumferential groove may enter and lock in the ring, but may be removed by a predetermined force exerted while pulling apart the locking pins. FIG. 9B illustrates, by schematic or view 950, the locking pins with heads 956A, 956B and having threads that thread through a hole in the strands and into the threaded tunnel 954 of strands of a different section or a different end of a same section of a wearable device. While the embodiments are illustrated to various wearable devices with exchangeable parts, the embodiments illustrate various grooves, guide paths, locking members, latching members, and latch, in specific adaptations, to enable the wearable devices with exchangeable parts. Accordingly, each specific adaptation offers independent uniqueness as well as shared uniqueness.

Figure 10:
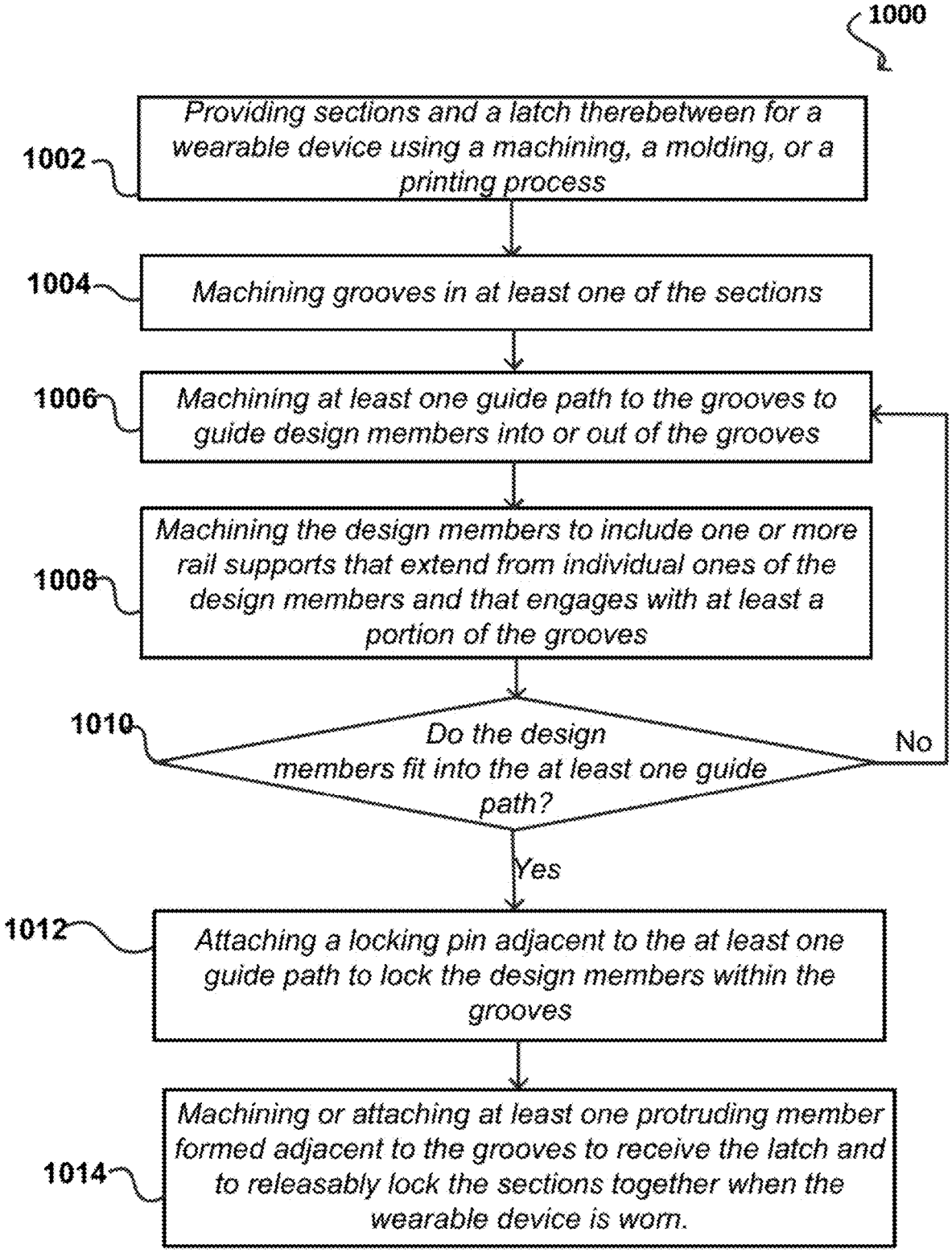
FIG. 10 is an example process flow for a method of manufacturing a wearable device with exchangeable parts in accordance with the present disclosure.

FIG. 10 is an example process flow 1000 for a method of manufacturing a wearable device with exchangeable parts in accordance with the present disclosure. Sub-process 1002 provides sections for the wearable device. Sub-process 1002 may provide the sections by machining or molded raw material, and then cutting the raw machined or molded parts using a computer numeric control (CNC) cutter with computer-aided design (CAD) used in the process. As such, the sections have a symmetrical design formed from a machining, a molding, or a printing process. Sub-process 1002 also requires providing a latch between the sections. This may be a welded-on latch, or part of the CNC cutter process—in a separate or subsequent step from sub-process 1002. Sub-process 1004 is a machining process for machining grooves in at least one of the sections. Sub-process 1006 may also be a machining process for machining at least one guide path to the grooves to guide design members into or out of the grooves. Sub-process 1008 is for machining the design members to include one or more rail supports that extend from individual ones of the design members and that engages with at least a portion of the grooves. When the design members are of appropriate fit—determined via process 1010—a further machining process in sub-process 1012 is for attaching a locking pin adjacent to the at least one guide path to lock the design members within the grooves. A final machining or attaching process at sub-process 1014 then ensures that at least one protruding member is formed adjacent to the grooves to receive the latch and to enable releasable locking of the sections together when the wearable device is worn.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, other the recesses can be put into arrangements other than those described, such as all being in a vertical or other arrangement. These and other similar modifications will readily suggest themselves to those skilled in the art, and are intended to be encompassed within the spirit of the present invention disclosed herein and the scope of the appended claims.

In the various embodiments of the disclosure described, a person having ordinary skill in the art will recognize that alternative arrangements of components, units, conduits, and fibers could be conceived and applied to the present invention.

The singular forms "a," "an," and "the" include plural referents, unless the context clearly dictates otherwise.

Examples of a computer-readable medium used in the wearable devices—particularly as to the dynamic design members—and is enabled for communications achieved for the wearable devices in the present embodiments can include but are not limited to: one or more nonvolatile, hard-coded type media, such as read only memories (ROMs), or erasable, electrically programmable read only memories (EEPROMs); recordable type media, such as flash drives, memory sticks, and other newer types of memories; and transmission type media such as digital and analog communication links. For example, such media can include operating instructions, as well as instructions related to the systems and the method steps described previously and can operate on a computer. It will be understood by those skilled in the art that such media can be at other locations instead of, or in addition to, the locations described to store computer program products, e.g., including software thereon. It will be understood by those skilled in the art that the various software modules or electronic components described previously can be implemented and maintained by electronic hardware, software, or a combination of the two, and that such embodiments are contemplated by embodiments of the present disclosure.

What is claimed is:

1. A wearable device comprising:

one or more design members;

at least one ornamental member having one or more grooves to move the one or more design members into or out of the at least one ornamental member through at least one guide path;

a latch associated with the at least one guide path and having at least one locking member for interlocking, at least partially, with a port of the at least one ornamental member; and an abutment of the at least one locking member to be within the at least one guide path to restrict the design members to within the one or more grooves.

2. The wearable device of claim 1, wherein the at least one locking member is spring loaded. screwed, or inserted to cause the abutment of the at least one locking member to be within the at least one guide path.

3. The wearable device of claim 1, further comprising:

a narrowing or ridging in the port of the at least one ornamental member for the interlocking, at least partially, of the at least one locking member of the latch with the port.

4. The wearable device of claim 1, further comprising:

a key comprising a counterlock pin to the at least one locking member, the counterlock pin to push the at least one locking member from a locked position to an unlocked position to unlatch the latch and to enable release of the design members.

5. The wearable device of claim 1, wherein an individual design member of the design members comprises one or more of:

a first portion of the individual design member attached to a second portion of the individual design member;

one or more rail supports that extend from the individual design member to engage with at least one portion of the one or more grooves;

a digital display; and a body sensor.

6. The wearable device of claim 1, further comprising:

a key to be used with the at least one locking member to change the latch from a locked position to an unlocked position and to enable release of the design members from the at least one ornamental member.

7. The wearable device of claim 1, further comprising:

a key comprising grip surfaces to be used to position or energize the key with the at least ornamental member, the key to be used with the at least one locking member to change the latch from a locked position to an unlocked position and to enable release of the design members from the at least one ornamental member.

8. The wearable device of claim 1, further comprising:

a circumferential groove of the at least one locking member for the interlocking, at least partially, of the at least one locking member with the port of the at least one ornamental member.

9. The wearable device of claim 1, further comprising:

a first section of at least one ornamental member having the latch; and a second section of the at least one ornamental member having the port.

10. The wearable device of claim 1, further comprising:

at least one side of the latch to fit into the at least one guide path to restrict the design members to within the one or more grooves.

11. A method for a wearable device, the method comprising:

enabling one or more grooves and at least one guide path for at least one ornamental member to move one or more design members into or out of the at least one ornamental member through the at least one guide path;

associating a latch with the at least one guide path and having at least one locking member for interlocking, at least partially, with a port of the at least one ornamental member;

enabling the one or more design members to interchangeably fit within the one or more grooves of the at least one ornamental member; and providing an abutment of the at least one locking member to be within the at least one guide path to restrict the design members to within the one or more grooves.

12. The method of claim 11, wherein the at least one locking member is spring loaded, screwed. or inserted to cause the abutment of the at least one locking member to be within the at least one guide path.

13. The method of claim 11, further comprising:

machining a narrowing or ridging in the port of the at least one ornamental member for the interlocking, at least partially, of the at least one locking member of the latch with the port.

14. The method of claim 11, further comprising:

enabling a key comprising a counterlock pin to the at least one locking member, the counterlock pin to push the at least one locking member from a locked position to an unlocked position to unlatch the latch and to enable release of the design members.

15. The method of claim 11, further comprising, wherein an individual design member of the design members comprises one or more of:

a first portion of the individual design member attached to a second portion of the individual design member;

one or more rail supports that extend from the individual design member to engage with at least one portion of the one or more grooves;

a digital display; and a body sensor.

16. The method of claim 11, further comprising:

enabling a key to be used with the at least one locking member to change the latch from a locked position to an unlocked position and to enable release of the design members from the at least one ornamental member.

17. The method of claim 11, further comprising:

enabling a key to comprise grip surfaces to be used to position or energize the key with the at least ornamental member, the key to be used with the at least one locking member to change the latch from a locked position to an unlocked position and to enable release of the design members from the at least one ornamental member.

18. The method of claim 11, further comprising:

machining a circumferential groove of the at least one locking member for the interlocking, at least partially, of the at least one locking member with the port of the at least one ornamental member.

19. The method of claim 11, further comprising:

providing a first section of at least one ornamental member to comprise the latch; and providing a second section of the at least one ornamental member to comprise the port.

20. The method of claim 11, further comprising:

enabling at least one side of the latch to fit into the at least one guide path to restrict the design members to within the one or more grooves.

* * * * *